US008629738B2

(12) United States Patent
Yoshikawa

(10) Patent No.: US 8,629,738 B2
(45) Date of Patent: Jan. 14, 2014

(54) COMPLEX RESONATOR, BANDPASS FILTER, AND DIPLEXER, AND WIRELESS COMMUNICATION MODULE AND WIRELESS COMMUNICATION DEVICE USING SAME

(75) Inventor: Hiromichi Yoshikawa, Kirishima (JP)

(73) Assignee: Kyocera Corporation, Kyoto (JP)

( * ) Notice: Subject to any disclaimer, the term of this patent is extended or adjusted under 35 U.S.C. 154(b) by 729 days.

(21) Appl. No.: 12/919,479

(22) PCT Filed: Feb. 18, 2009

(86) PCT No.: PCT/JP2009/052811

§ 371 (c)(1),
(2), (4) Date: Aug. 25, 2010

(87) PCT Pub. No.: WO2009/107532

PCT Pub. Date: Sep. 3, 2009

(65) Prior Publication Data

US 2011/0006857 A1 Jan. 13, 2011

(30) Foreign Application Priority Data

Feb. 26, 2008 (JP) ..... 2008 043880
Feb. 26, 2008 (JP) ..... 2008 043881
Mar. 24, 2008 (JP) ..... 2008 075243

(51) Int. Cl.
*H01P 1/213* (2006.01)
*H01P 1/203* (2006.01)
*H01P 7/08* (2006.01)

(52) U.S. Cl.
USPC ..... 333/134; 333/219; 333/204

(58) Field of Classification Search
USPC ..... 333/126, 127, 128, 132, 134, 136, 219, 333/204
See application file for complete search history.

(56) References Cited

U.S. PATENT DOCUMENTS 6,411,178 B1 * 6/2002 Matsumura et al. ..... 333/134
7,116,186 B2 * 10/2006 Chen ..... 333/126

(Continued)

FOREIGN PATENT DOCUMENTS

JP 63257302 A 10/1988
JP 200216403 A 7/2003

(Continued)

OTHER PUBLICATIONS

Li, K., et al., "An Ultra-Wideband Bandpass Filter Using Broadside-Coupled Microstrip-Coplanar Waveguide Structure," Proceedings of the Mar. 2005 IEICE General Conference, C-2-114, p. 147.

(Continued)

*Primary Examiner* — Benny Lee
*Assistant Examiner* — Gerald Stevens
(74) *Attorney, Agent, or Firm* — Birch, Stewart, Kolasch & Birch, LLP

(57) ABSTRACT

Provided is a composite resonator wherein two resonance frequencies can be set discretionarily to a certain extent. The composite resonator is provided with a grounding electrode (21) arranged on a lower surface of a laminated body wherein a plurality of dielectric layers (11) are laminated, and a composite resonant electrode (26) arranged on an upper surface or inside of the laminated body. The composite resonant electrode (26) is composed of a base section (27) and a plurality of strip-like protruding sections (28*a*, 28*b*). One end of the base section (27) is grounded. One end of each of the protruding sections (28*a*, 28*b*) is connected to the other end of the base section (27), and the protruding sections are arranged in parallel. A body wherein the base section (27) and the protruding sections (28*a*, 28*b*) are combined functions, as a whole, as a resonator which resonates at a first frequency, and the protruding sections (28*a*, 28*b*) function as a resonator which resonates at a second frequency higher than the first frequency.

16 Claims, 28 Drawing Sheets

(56) References Cited

U.S. PATENT DOCUMENTS

| | | | | |
|---|---|---|---|---|
| 2004/0066256 | A1 | 4/2004 | Maekawa et al. | |
| 2007/0001786 | A1* | 1/2007 | Kundu | 333/204 |
| 2010/0164651 | A1* | 7/2010 | Erb | 333/204 |
| 2010/0253448 | A1 | 10/2010 | Yoshikawa et al. | |

FOREIGN PATENT DOCUMENTS

| | | | |
|---|---|---|---|
| JP | 2004147300 | A | 5/2004 |
| JP | 2004-180032 | A | 6/2004 |

OTHER PUBLICATIONS

Cai, P. et al., "Synthesis Theory and Implementation Method of Novel Microwave and Millimeter-Wave Ultra-Wideband Bandpass Filters," IEICE Microwave Workshop Digest, Nov. 2007, Session No. WS12-2, pp. 331-336.

* cited by examiner

COMPLEX RESONATOR, BANDPASS FILTER, AND DIPLEXER, AND WIRELESS COMMUNICATION MODULE AND WIRELESS COMMUNICATION DEVICE USING SAME

The present application is a National Stage application of International Application PCT/JP2009/052811 filed on Feb. 18, 2009, which designates the United States of America. This application also claims priority under 35 USC §119(a) of Japanese Applications JP2008-043880 and JP208-043881 filed Feb. 26, 2008, and Japanese Application JP2008-075243 filed Mar. 24, 2008.

TECHNICAL FIELD

The present invention relates to a resonator used for a filter circuit or an oscillation circuit, etc., and specifically relates to a complex resonator that has a plurality of resonance frequencies and can easily realize a wideband bandpass filter. Moreover, the present invention relates to a bandpass filter as well as a wireless communication module and a wireless communication device using the same, and specifically relates to a bandpass filter having a substantially wide passband as well as a wireless communication module and a wireless communication device using the same. Furthermore, the present invention relates to a diplexer as well as a wireless communication module and a wireless communication device using the same, and specifically relates to a diplexer that can demultiplex and multiplex two signals having a substantially wide frequency band as well as a wireless communication module and a wireless communication device using the same.

BACKGROUND

Recently, as a new communications means, UWB has been attracting attention. UWB realizes the transfer of large volumes of data over short distances of approximately 10 m by using a wide frequency band (e.g., a frequency band ranging from 3.1 to 10.6 GHz) and there are plans for its use according to the regulations of the FCC (Federal Communication Commission) in the U.S. In this way, UWB is characterized by using a substantially wide frequency band.

Research on bandpass filters having a substantially wide passband and can be used for such UWB has been actively carried out in recent years, and in one study, for example, it was reported that a characteristic feature in which a substantially wide passband with a passband width exceeding 100% of the fractional bandwidth (bandwidth/center frequency) was obtained by using a bandpass filter to which the principles of a directional coupler were applied (e.g., refer to "An ultra-wideband bandpass filter using a microstrip-CPW broadside coupled structure", Proceedings of the March 2005 IEICE General Conference, C-2-114, p. 147).

Meanwhile, as a commonly used conventional bandpass filter, one in which a plurality of ¼ wavelength stripline resonators is installed in parallel and configured to couple with each other is known (e.g., refer to Unexamined Patent Publication No. 2004-180032).

However, the bandpass filters proposed in "An ultra-wideband bandpass filter using a microstrip-CPW broadside coupled structure" (Proceeding of the March 2005 IEICE General Conference, C-2-114 p. 147) and Unexamined Patent Publication No. 2004-180032 each had problems and were not appropriate for UWB.

For example, the bandpass filter proposed in "An ultra-wideband bandpass filter using a microstrip-CPW broadside coupled structure" (Proceeding of the March 2005 IEICE General Conference, C-2-114 p. 147) had a problem in that the passband width was too wide. In other words, the UWB basically uses a frequency band ranging from 3.1 GHz to 10.6 GHz, whereas the Radiocommunications Sector of the International Telecommunication Union proposes a plan to demultiplex into Low Band using a frequency band ranging from approximately 3.1 to 4.7 GHz and High Band using a frequency band ranging from approximately 6 GHz to 10.6 GHz, thus avoiding the use of 5.3 GHz at IEEE802.11.a. Accordingly, because a filter for Low Band that allows Low Band to pass and a filter for High Band that allows High Band to pass each required both a passband width ranging from approximately 40% to 50% of the fractional bandwidth and attenuation at 5.3 GHz, the bandpass filter proposed in "A ultra-wideband bandpass filter using a microstrip-CPW broadside coupled structure" (Proceeding of the March 2005 IEICE General Conference C-2-114 p. 147) having a characteristic feature with a passband width greater than 100% of the fractional bandwidth cannot be used due to its wide passband width.

Additionally, the passband width of the bandpass filter using a conventional ¼ wavelength resonator is too narrow, and even the passband width of the bandpass filter described in Unexamined Patent Publication No. 2004-180032, which attempted to provide a wider bandwidth, was less than 10% of the fractional bandwidth. Accordingly, it cannot be used as a bandpass filter for UWB, which requires a wide passband width corresponding to 40% to 50% of the fractional bandwidth.

Furthermore, if both Low Band and High Band are used, because a circuit processing Low Band signals and a circuit processing High Band signals are different in the RF IC that processes radio-frequency signals, the antenna side may have two terminals, thus increasing the need for a diplexer that connects the terminal on the Low Band side and the terminal on the High Band side to the antenna. In addition, such a diplexer requires that isolation between the terminal on the Low Band side and the terminal on the High Band side is sufficiently secured.

DISCLOSURE OF THE INVENTION

Problems to be Solved by the Invention

The present invention has been devised in view of the problems in the prior art, with the objective of providing a complex resonator that can easily configure a bandpass filter having a substantially wide and a desired passband width and optionally set two resonance frequencies to some degree.

Another objective of the present invention is to provide a bandpass filter having a substantially wide and a desired passband width as well as a wireless communication module and a wireless communication device using the same. Still another objective of the present invention is to provide a diplexer that cannot only demultiplex and multiplex two signals having a substantially wide frequency band but also has excellent isolation characteristics, as well as a wireless communication module and a wireless communication device using the same.

Means for Solving the Problems

A complex resonator of the present invention comprises a laminated body, a ground electrode, and a complex resonance electrode. The laminated body is composed by laminating a plurality of dielectric layers. The ground electrode is disposed on the bottom surface of the laminated body. The complex resonance electrode is disposed on the top surface of or within the laminated body. The complex resonance electrode is composed of a base member and a plurality of belt-like protruding members. One end of the base member is grounded. The plurality of protruding members is disposed side by side so that each one end thereof is connected to the other end of the base portion. The one end of the base member becomes one end of the complex resonance electrode, and the other end of the protruding members becomes the other end of the complex resonance electrode. The one end of the complex resonance electrode is grounded, resulting in the entire body combining the base member with the protruding members functioning as a resonator that resonates at a first frequency and the protruding members functioning as a resonator that resonates at a second frequency higher than the first frequency.

Additionally, the bandpass filter of the present invention comprises a laminated body, a ground electrode, a complex resonance electrode, a belt-like input coupling electrode, and a belt-like output coupling electrode. The laminated body is composed by laminating a plurality of dielectric layers. The ground electrode is disposed on the bottom surface of the laminated body. The complex resonance electrode is disposed on a first interlayer of the laminated body. The complex resonance electrode is composed on a base member and a plurality of belt-like protruding members. One end of the base member is grounded. The plurality of protruding members is disposed side by side so that each one end thereof is connected to the other end of the base portion. The one end of the base member becomes one end of the complex resonance electrode, and the other end of the protruding members becomes the other end of the complex resonance electrode. The one end of the complex resonance electrode is grounded, resulting in the entire body combining the base member with the protruding members functioning as a resonator that resonates at a first frequency and the protruding members functioning as a resonator that resonates at a second frequency higher than the first frequency. The input coupling electrode is disposed on an interlayer different from the first interlayer of the laminated body and electromagnetically coupled so as to face against the protruding members on the input stage of the plurality of protruding members on the complex resonance electrode. The input coupling electrode has an electrical signal input point into which electrical signals are input. The output coupling electrode is disposed on an interlayer different from the first interlayer of the laminated body and electromagnetically coupled so as to face against the protruding members on the output stage of the plurality of protruding members on the complex resonance electrode. The output coupling electrode has an electrical signal output point from which electrical signals are output.

Furthermore, the bandpass filter of the present invention comprises a laminated body, a ground electrode, a plurality of complex resonance electrodes, a belt-like input coupling electrode, and a belt-like output coupling electrode. The laminated body is composed by laminating a plurality of dielectric layers. The ground electrode is disposed on the bottom surface of the laminated body. The complex resonance electrode is composed of a base member and a plurality of belt-like protruding members. One end of the base member is grounded. The plurality of protruding members is disposed side by side so that each one end thereof is connected to the other end of the base portion. The one end of the base member becomes one end of the complex resonance electrode, and the other end of the protruding members becomes the other end of the complex resonance electrode, and one end of the complex resonance electrode is grounded, the entire body combining the base member with the protruding members functioning as a resonator that resonates at first frequency, and the protruding members functioning as a resonator that resonates at second frequency higher than the first frequency. The plurality of complex resonance electrodes comprises a first interlayer of the laminated body, on which one end and the other end of each complex resonance electrode are disposed side by side so as to alternate and become electromagnetically coupled to each other. The input coupling electrode is disposed on an interlayer different from the first interlayer of the laminated body and electromagnetically coupled so as to face against the protruding members on the input stage of the plurality of protruding members on the complex resonance electrode on the input stage of the plurality of complex resonance electrodes. The input coupling electrode has an electrical signal input point into which electrical signals are input. The output coupling electrode is disposed on an interlayer different from the first interlayer of the laminated body and electromagnetically coupled so as to face against the protruding members on the output stage of the plurality of protruding members on the complex resonance electrode on the output stage of the plurality of complex resonance electrodes. The output coupling electrode has an electrical signal output point from which electrical signals are output.

The diplexer of the present invention comprises a laminated body, a ground electrode, a plurality of complex resonance electrodes, a plurality of belt-like single resonance electrodes, a belt-like input coupling electrode, a belt-like first output coupling electrode, and a belt-like second output coupling electrode. The laminated body is composed by laminating a plurality of dielectric layers. The ground electrode is disposed on the bottom surface of the laminated body. The complex resonance electrode is composed of a base member and a plurality of belt-like protruding members. One end of the base member is grounded. The plurality of protruding members is disposed side by side so that each one end thereof is connected to the other end of the base portion. The one end of the base member becomes one end of the complex resonance electrode, and the other end of the protruding members becomes the other end of the complex resonance electrode. The one end of the complex resonance electrode is grounded, resulting in the entire body combining the base member with the protruding members functioning as a resonator that resonates at a first frequency, and the protruding members functioning as a resonator that resonates at a second frequency higher than the first frequency. The plurality of complex resonance electrodes comprises a first interlayer of the laminated body, on which the one end and the other end of each the complex resonance electrode are disposed side by side so as to alternate and become electromagnetically coupled to each other. The plurality of single resonance electrodes is disposed side by side so as to be alternately electromagnetically coupled on a second interlayer different from the first interlayer of the laminated body, resulting in each one end being grounded and thus functioning as a resonator that resonates at a third frequency different from the first frequency and the second frequency. The input coupling electrode is disposed on an interlayer located between the first interlayer of the laminated body and the second interlayer, electromagnetically coupled so as to face against the protruding members on the input stage of the plurality of protruding members on the complex resonance electrode on the input stage of the plurality of complex resonance electrodes, and electromagnetically coupled so as to face against the single resonance electrode on the input stage of the plurality of single resonance electrodes. The input coupling electrode has an electrical signal input point into which electrical signals are input. The first output coupling electrode is disposed on an interlayer different from the first interlayer of the laminated body and electromagnetically coupled so as to face against the protruding members on the output stage of the plurality of protruding members on the complex resonance electrode on the output stage of the plurality of complex resonance electrodes. The first output coupling electrode has a first electrical signal output point from which electrical signals are output. The second output coupling electrode is disposed on an interlayer different from the second interlayer of the laminated body and electromagnetically coupled so as to face against a single resonance electrode on the output stage of the plurality of single resonance electrodes. The second output coupling electrode has a second electrical signal output point from which electrical signals are output.

The wireless communication module of the present invention comprises an RF portion including the bandpass filter or diplexer of the present invention and a baseband portion connected to the RF portion.

The wireless communication device of the present invention comprises an RF portion including the bandpass filter or diplexer of the present invention, a baseband portion connected to the RF portion, and an antenna connected to the RF portion.

In addition, "an interlayer different from the first interlayer" described herein refers to an interlayer other than the first interlayer and may be one interlayer or a plurality of interlayers. Accordingly, "an electrode disposed on an interlayer different from the first interlayer" may be disposed on one interlayer other than the first interlayer, or may be one in which parts are disposed so as to be divided into a plurality of interlayers other than the first interlayer are joined together. Similarly, "an interlayer located between the first interlayer and the second interlayer" may also be one interlayer or a plurality of interlayers. Additionally, "for an input coupling electrode, the side closer to the other end of the complex resonance electrode on the input stage than the center of a portion facing against the complex resonance electrode on the input stage" refers to a region on the side including a portion that is the closest to the other end of the complex resonance electrode on the input stage when dividing the input coupling electrode into two regions in a longitudinal direction at the boundary of the center of a portion facing against the complex resonance electrode on the input stage. Furthermore, "protruding members on the input stage" refers to protruding members that are located outermost among a plurality of protruding members disposed side by side on the complex resonance electrode and into which electrical signals are input, and "protruding members on the output stage" refers to protruding members that are located outermost among a plurality of protruding members disposed side by side on the complex resonance electrode and from which electrical signals are output. Furthermore, "a complex resonance electrode on the input stage" refers to a complex resonance electrode that is located outermost among a plurality of complex resonance electrodes disposed side by side and into which electrical signals are input, and "a complex resonance electrode on the output stage" refers to a complex resonance electrode that is located outermost among a plurality of complex resonance electrodes disposed side by side and from which electrical signals are output. Furthermore, "an electrical signal input point" of the input coupling electrode refers to a location where electrical signals are input into the input coupling electrode, and "an electrical signal output point" of the output coupling electrode refers to a location where electrical signals are output from the output coupling electrode.

BRIEF DESCRIPTION OF DRAWINGS

The objectives, features, and advantages of the present invention will be apparent from the following description of embodiments and the figures.

BEST MODE FOR CARRYING OUT THE INVENTION

Hereinafter, a complex resonator, a bandpass filter, a diplexer, and a wireless communication module and a wireless communication device using the same according to the present invention are described in detail with reference to the figures.

First Embodiment

Figure 1:
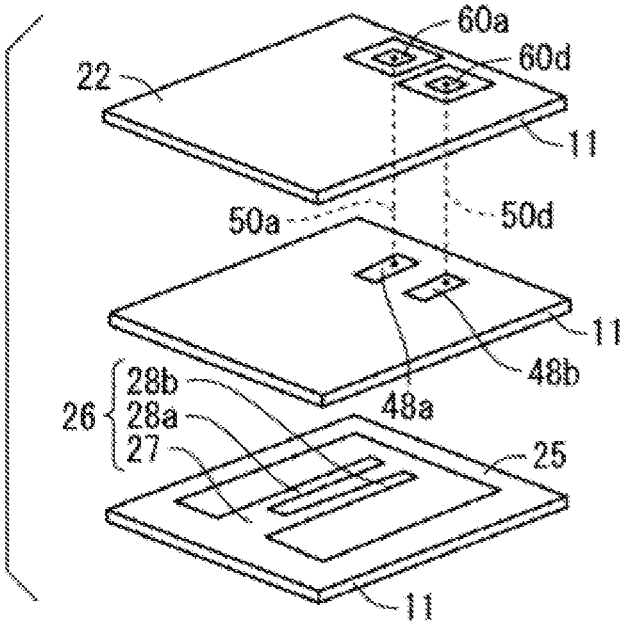
FIG. 1 is an exploded perspective view schematically showing an example of the structure of a complex resonator according to the first embodiment of the present invention.
Figure 2:
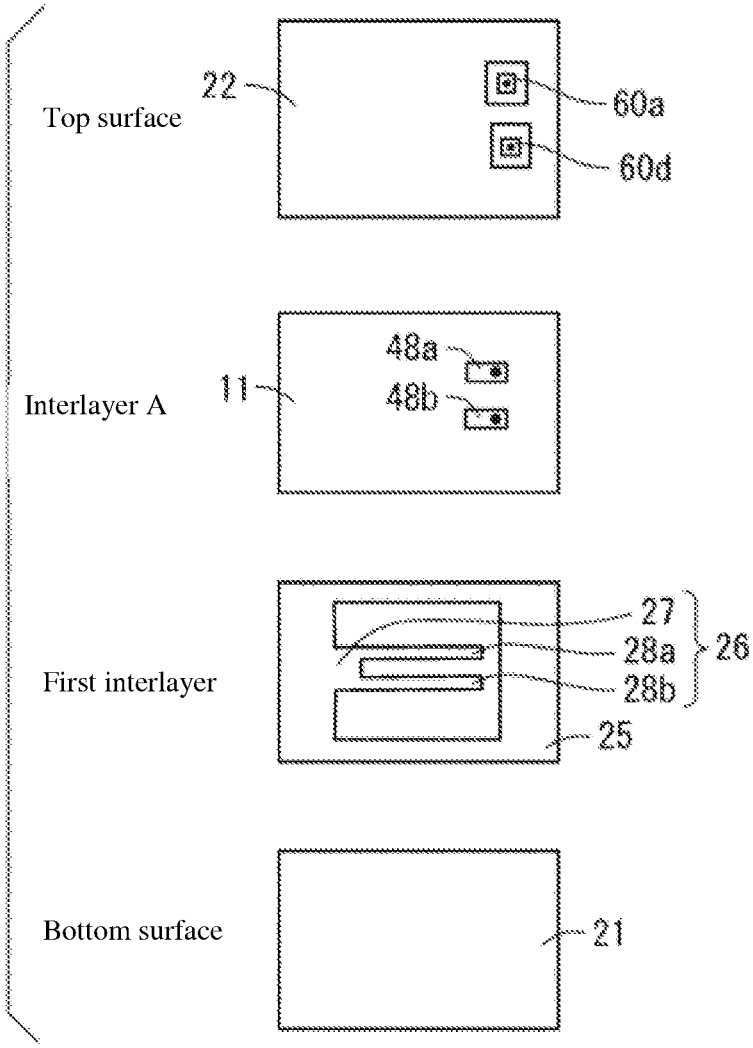
FIG. 2 is a plain view schematically showing the top and bottom surfaces and interlayer of the complex resonator shown in FIG. 1.

FIG. 1 is an exploded perspective view schematically showing an example of the structure of a complex resonator according to the first embodiment of the present invention. FIG. 2 is a plain view schematically showing the top and bottom surfaces and interlayer of the complex resonator shown in FIG. 1.

The complex resonator that makes up the bandpass filter according to this embodiment, as shown in FIG. 1 and FIG. 2, comprises a first ground electrode 21, a second ground electrode 22, and a complex resonance electrode 26. A laminated body is composed by laminating a plurality of dielectric layers 11. The first ground electrode 21 is disposed on the bottom surface of the laminated body. The second ground electrode 22 is disposed on the top surface of the laminated body. The complex resonance electrode 26 is disposed on a first interlayer of the laminated body. The complex resonance electrode 26 is composed of a base member 27 and a plurality of belt-like protruding members 28*a*, 28*b*. One end of the base member 27 is grounded. The plurality of protruding members 28*a*, 28*b* is disposed side by side so that each one end is connected to the other end of the base member 27. One end of the base member 27 becomes one end of the complex resonance electrode 26 and the other end of the protruding members 28*a*, 28*b* becomes the other end of the complex resonance electrode 26. One end of the complex resonance electrode 26 is grounded, resulting in the entire body combining the base member 27 with the protruding members 28*a*, 28*b* functioning as a resonator that resonates at a first frequency and the protruding members 28*a*, 28*b* functioning as a resonator that resonates at a second frequency higher than the first frequency. Additionally, on the first interlayer of the laminated body, an annular ground electrode 25 is disposed so as to surround the circumference of the complex resonance electrode 26 and one end of the complex resonance electrode 26 is connected to the annular ground electrode 25. Furthermore, on the interlayer A different from the first interlayer of the laminated body, a coupling electrode for inputting 48*a* electromagnetically coupled so as to face against the protruding members on the input stage 28*a* and a coupling electrode for outputting 48*b* electromagnetically coupled so as to face against the protruding members on the output stage 28*b* are disposed. In turn, the coupling electrode for inputting 48*a* and the coupling electrode for outputting 48*b* are respectively connected to an input terminal electrode 60*a* and an output terminal electrode 60*d* that are disposed on the top surface of the laminated body so as to be separated from the second ground electrode 22 via through—conductors 50*a*, 50*d*.

The complex resonator comprising such a structure—where one end is grounded, resulting in the entire body combining the base member 27 and the protruding members 28*a*, 28*b* functioning as a resonator that resonates at a first frequency and the protruding members 28*a*, 28*b* functioning as a resonator that resonates at a second frequency higher than first frequency—comprises the complex resonance electrode 26 and thus functions as a resonator having two resonance frequencies. At this time, it is believed that at the first frequency, one end of the complex resonance electrode 26 becomes a short-circuited end and the other end of the complex resonance electrode 26 becomes an open end, resulting in the entire body of the complex resonance electrode 26 functioning as a ¼ wavelength resonator, and at the second frequency, one end of the protruding members 28*a*, 28*b* becomes a substantially short-circuited end and the other end of the protruding members 28*a*, 28*b* becomes an open end, resulting in the protruding members 28*a*, 28*b* functioning as a ¼ wavelength resonator.

In turn, according to complex resonator of this embodiment having such a structure, one end connected to grounding potential naturally becomes wider in width, and therefore, a resonator with a high Q value can be obtained. Additionally, because the difference in frequency between the first frequency and the second frequency can be optionally controlled to some degree depending on the length of the protruding members 28*a*, 28*b*, the difference in frequency between the first frequency and the second frequency can be easily set to a desired value. Therefore, with this complex resonator, it is possible to easily configure, for example, a bandpass filter having a desired passband width and dual-mode oscillation circuit that oscillates at two desired frequencies, etc. Accordingly, it is possible to easily configure a bandpass filter having a substantially wide passband width, which has been difficult to obtain with a bandpass filter using, for example, a conventional ¼ wavelength resonator.

Furthermore, because a plurality of protruding members 28*a*, 28*b* is disposed side by side and thus a plurality of complex resonance electrodes 26 can be arranged side by side to as to be electromagnetically coupled with each other, the plurality of complex resonators can be electromagnetically coupled with each other easily and in a small scale and a bandpass filter with a small size can be easily configured.

Figure 3:
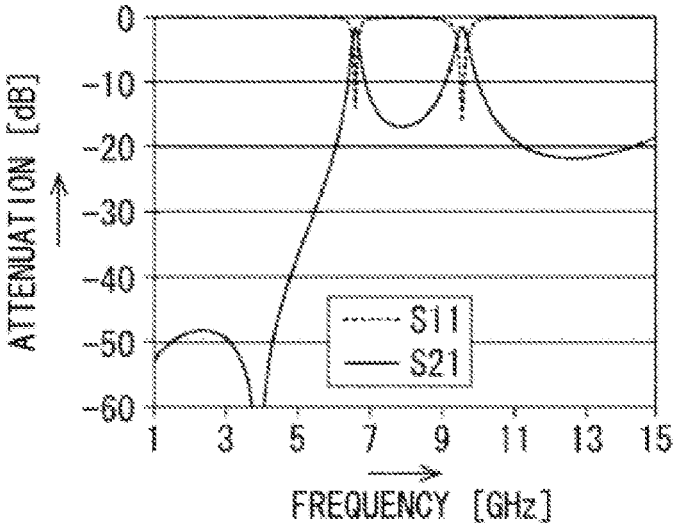
FIG. 3 is a diagram showing simulation results of the electrical characteristics of the complex resonator shown in FIG. 1.

FIG. 3 is a graph showing simulation results of the electrical characteristics of the complex resonator having the structure shown in FIG. 1 and FIG. 2. In the graph, the horizontal axis indicates frequency and the vertical axis indicates attenuation, showing the bandpass characteristics (S21) and reflection characteristics (S11) of the complex resonator, wherein the input terminal electrode 60*a* is port 1 and the output terminal electrode 60*d* is port 2. According to the graph shown in FIG. 3, the resonance peaks exist at two locations around 6.6 GHz and 9.6 GHz, suggesting that it functions as a complex resonator having two resonance frequencies.

In this simulation, the complex resonance electrode 26 is structured so that the rectangular protruding members on the input stage 28*a* and protruding members on the output stage

28*b* that are 0.25 mm in width and 2.0 mm in length are disposed 0.65 mm apart from the other end of the rectangular base member 27 that is 1.15 mm in width and 1.05 mm in length. The coupling electrode for inputting 48*a* and the coupling electrode for outputting 48*b* are made into a rectangle 0.25 mm in width and 1.0 mm in length so as to face by 0.2 mm in length against the protruding members on the input stage 28*a* and the protruding members on the output stage 28*b*, respectively. The input terminal electrode 60*a* and the output terminal electrode 60*d* is made into a square 0.3 mm on each side. The outlines of the first ground electrode 21, the second ground electrode 22, and the annular ground electrode 25 are made into a rectangle 5.0 mm in length and 3.5 mm in width and the opening of the annular ground electrode 25 is made into a rectangle 2.7 mm in width and 3.75 mm in length. The entire shape is made into a rectangular parallelepiped 5.0 mm in width, 3.5 mm in length, and 0.98 mm in thickness. The space between the interlayer where the complex resonance electrode 26 is disposed and the interlayer where the coupling electrode for inputting 48*a* and the coupling electrode for outputting 48*b* are disposed (the space between various types of electrodes disposed on respective interlayer) is made to be 0.065 mm. The thickness of the various types of electrode is made to be 0.01 mm and the diameter of the through-conductors 50*a*, 50*d* is made to be 0.1 mm. The relative permittivity of the dielectric layers 11 is made to be 9.45.

In addition, although the complex resonator shown in FIG. 1 and FIG. 2 provides an example where the complex resonance electrode 26 and the annular ground electrode 25 are disposed on the first interlayer of the laminated body and the first ground electrode 21 and the second ground electrode 22 are disposed on the top and bottom surfaces of the laminated body, the second ground electrode 22 and the annular ground electrode 25 are not necessarily required, and the complex resonance electrode 26 may be disposed on the top surface of the laminated body.

Additionally, the coupling electrode for inputting 48*a* and the coupling electrode for outputting 48*b* may be disposed on the same interlayer as the complex resonance electrode, and in cases in which a plurality of complex resonators are coupled, for example, either may be sufficient for the complex resonator on the input stage and the output stage. The input terminal electrode 60*a* and output terminal electrode 60*d* are also not necessarily required.

Second Embodiment

Figure 4:
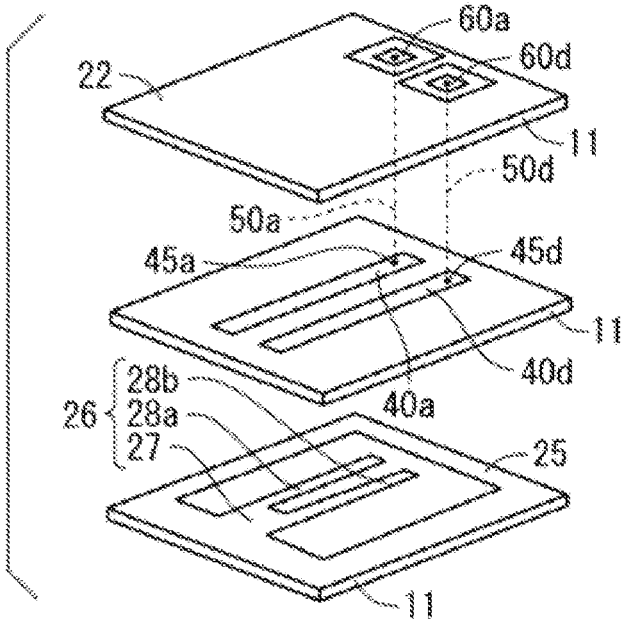
FIG. 4 is an exploded perspective view schematically showing the bandpass filter according to the second embodiment of the present invention.
Figure 5:
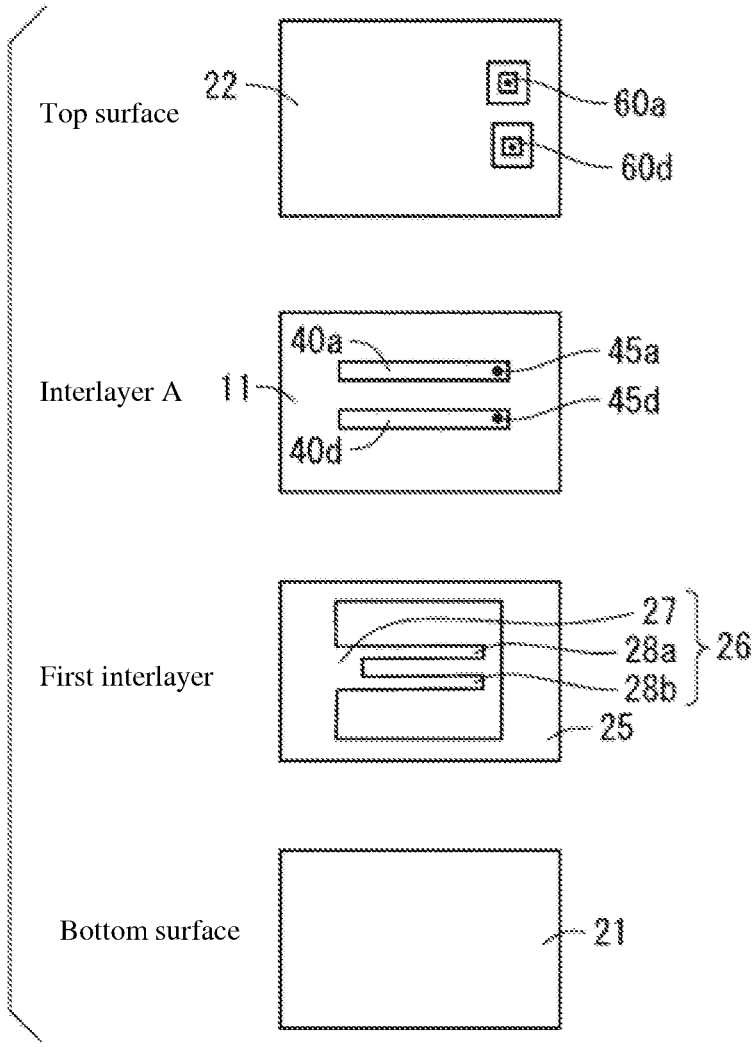
FIG. 5 is a plain view schematically showing the top and bottom surfaces and interlayer of the bandpass filter shown in FIG. 4.

FIG. 4 is an exploded perspective view schematically showing the bandpass filter according to the second embodiment of the present invention, and FIG. 5 is a plain view schematically showing the top and bottom surfaces and interlayer of the bandpass filter shown in FIG. 4.

In addition, in this embodiment, only aspects different from the abovementioned first embodiment will be explained so as to omit redundant explanations, and the same reference characters are used for similar components.

The bandpass filter of this embodiment, as shown in FIG. 4 and FIG. 5, comprises a laminated body, a first ground electrode 21, a second ground electrode 22, a complex resonance electrode 26, and an annular ground electrode 25. Additionally, on the interlayer A of the laminated body, an input coupling electrode 40*a* electromagnetically coupled so as to face against the protruding members on the input stage 28*a* and an output coupling electrode 40*d* electromagnetically coupled so as to face against the protruding members on the output stage 28*b* are disposed. In turn, the input coupling electrode 40*a* and the output coupling electrode 40*d* are respectively connected to an input terminal electrode 60*a* and an output terminal electrode 60*d* that are disposed on the top surface of the laminated body apart from the second ground electrode 22 via through-conductors 50*a*, 50*d*. Accordingly, the electrical signal input point 45*a* of the input coupling electrode 40*a* is a connection point between the input coupling electrode 40*a* and the through-conductors 50*a*, and the electrical signal output point 45*d* of the output coupling electrode 40*d* is a connection point between the output coupling electrode 40*d* and the through-conductors 50*d*.

Furthermore, in the bandpass filter of this embodiment, on the input coupling electrode 40*a*, the electrical signal input point 45*a* is located on a side closer to the other end of the complex resonance electrode 26 than the center of a portion facing against the complex resonance electrode 26, and on the output coupling electrode 40*d*, the electrical signal output point 45*d* is located on a side closer to the other end of the complex resonance electrode 26 than the center of a portion facing against the complex resonance electrode 26.

In the bandpass filter of this embodiment having such a structure, when electrical signals are input from the external circuit into the electrical signal input point 45*a* of the input coupling electrode 40*a* via the input terminal electrode 60*a* and the through-conductors 50*a*, the complex resonance electrode 26 electromagnetically coupled to the input coupling electrode 40*a* resonates, and electrical signals are output into the external circuit from the electrical signal output point 45*d* of the output coupling electrode 40*d* electromagnetically coupled to the complex resonance electrode 26 via the through-conductor 50*d* and the output terminal electrode 60*d*. At this time, because signals in the frequency band including the first frequency and the second frequency where the complex resonance electrode 26 resonates are selectively passed, it functions as a bandpass filter.

The bandpass filter of this embodiment comprises the complex resonance electrode 26, where the entire body combining the base member 27 with the protruding members 28*a*, 28*b* functions as a resonator that resonates at a first frequency, and the protruding members 28*a*, 28*b* functions as a resonator that resonates at a second frequency higher than the first frequency. Therefore, the difference in frequency between the first frequency and the second frequency can be optionally controlled to some degree depending on the length of the protruding members 28*a*, 28*b*, and thus a bandpass filter having a wide and a desired passband width can be easily obtained.

Additionally, because the bandpass filter of this embodiment comprises a belt-like input coupling electrode 40*a* electromagnetically coupled so as to face against the protruding members on the input stage 28*a* on the complex resonance electrode 26, which is disposed on an interlayer different from the interlayer where the complex resonance electrode 26 of the laminated body is disposed, and a belt-like output coupling electrode 40*d* electromagnetically coupled so as to face against the protruding members on the output stage 28*b* on the complex resonance electrode 26, which is disposed on an interlayer different from the interlayer where the complex resonance electrode 26 of the laminated body is disposed, the input coupling electrode 40*a* and output coupling electrode 40*d* and complex resonance electrode 26 are electromagnetically coupled via broadside coupling, and a bandpass filter having flat and low-loss bandpass characteristics can be obtained across the wide passband.

Furthermore, according to the bandpass filter of this embodiment, on the input coupling electrode 40*a*, the electrical signal input point 45*a* is located on a side closer to the other end of the complex resonance electrode 26 than the center of a portion facing against the complex resonance electrode 26, and on the output coupling electrode 40*d*, the electrical signal output point 45*d* is located on a side closer to the other end of the complex resonance electrode 26 than the center of a portion facing against the complex resonance electrode 26, and therefore, the input coupling electrode 40*a* and output coupling electrode 40*d* and the complex resonance electrode 26 are electromagnetically coupled in an inter-digital form and are thus strongly electromagnetically coupled with each other due to the addition of coupling via the magnetic field and coupling via the electric field, and therefore, a bandpass filter having flatter and lower-loss bandpass characteristics across the wide passband can be obtained.

Figure 6:
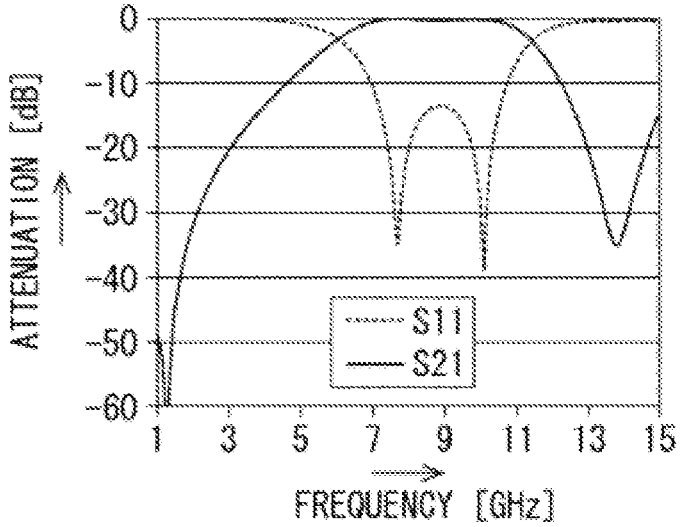
FIG. 6 is a diagram showing simulation results of the electrical characteristics of the bandpass filter according to the second embodiment of the present invention.

FIG. 6 is a graph showing simulation results of the electrical characteristics of the bandpass filter according to the second embodiment of the present invention having the structure shown in FIG. 4 and FIG. 5. In the graph, the horizontal axis indicates frequency and the vertical axis indicates attenuation, showing the bandpass characteristics (S21) and reflection characteristics (S11) of the complex resonator, wherein the input terminal electrode 60*a* is port 1 and the output terminal electrode 60*d* is port 2. According to the graph shown in FIG. 6, flat and low-loss bandpass characteristics have been obtained across the substantially wide passband width greater than 40% of the fractional bandwidth at around 7 GHz to 11 GHz, where effectiveness of the complex resonator of the present invention was observed.

In addition, in this simulation, the complex resonance electrode 26 is structured so that the rectangular protruding members on the input stage 28*a* and protruding members on the output stage 28*b* that are 1.15 mm in width and 1.05 mm in length are disposed 0.65-mm apart from the other end of the rectangular base member 27 that is 0.25 mm in width and 2.0 mm in length. The input coupling electrode 40*a* and the output coupling electrode 40*d* are made into a rectangle 0.25 mm in width and 3.0 mm in length. The input terminal electrode 60*a* and the output terminal electrode 60*d* is made into a square that is 0.3 mm on each side. The outlines of the first ground electrode 21, the second ground electrode 22, and the annular ground electrode 25 are made into a rectangle 5.0 mm in length and 3.5 mm in width and the opening of the annular ground electrode 25 is made into a rectangle 2.7 mm in width and 3.75 mm in length. The entire shape of the bandpass filter is made into a rectangular parallelepiped 5.0 mm in width, 3.5 mm in length, and 0.98 mm in thickness so that the complex resonance electrode 26 is located at the center in the thickness direction. The space between the interlayer where the complex resonance electrode 26 is disposed and the interlayer where the input coupling electrode 40*a* and the output coupling electrode 40*d* are disposed (the space between various types of electrodes disposed on respective interlayer) is made to be 0.065 mm. The thickness of the various types of electrode is made to be 0.01 mm and the diameter of the through-conductors 50*a*, 50*d* is made to be 0.1 mm. The relative permittivity of the dielectric layers 11 is made to be 9.45.

Additionally, although the bandpass filter of this embodiment shown in FIG. 4 and FIG. 5 provides an example where the input coupling electrode 40*a* and output coupling electrode 40*d* and the complex resonance electrode 26 are disposed to be electromagnetically coupled in an inter-digital form, the input coupling electrode 40*a* and output coupling electrode 40*d* and the complex resonance electrode 26 may be disposed to be coupled in a comb-line form.

Third Embodiment

Figure 7:
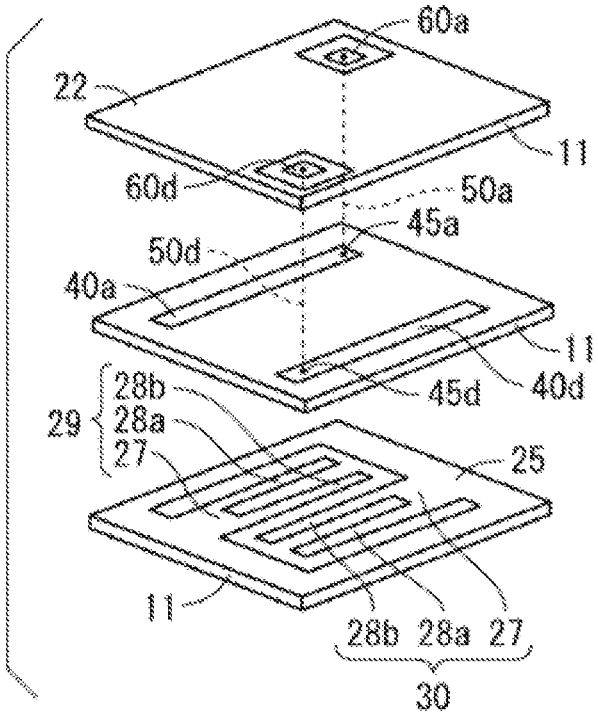
FIG. 7 is an exploded perspective view schematically showing the bandpass filter according to the third embodiment of the present invention.
Figure 8:
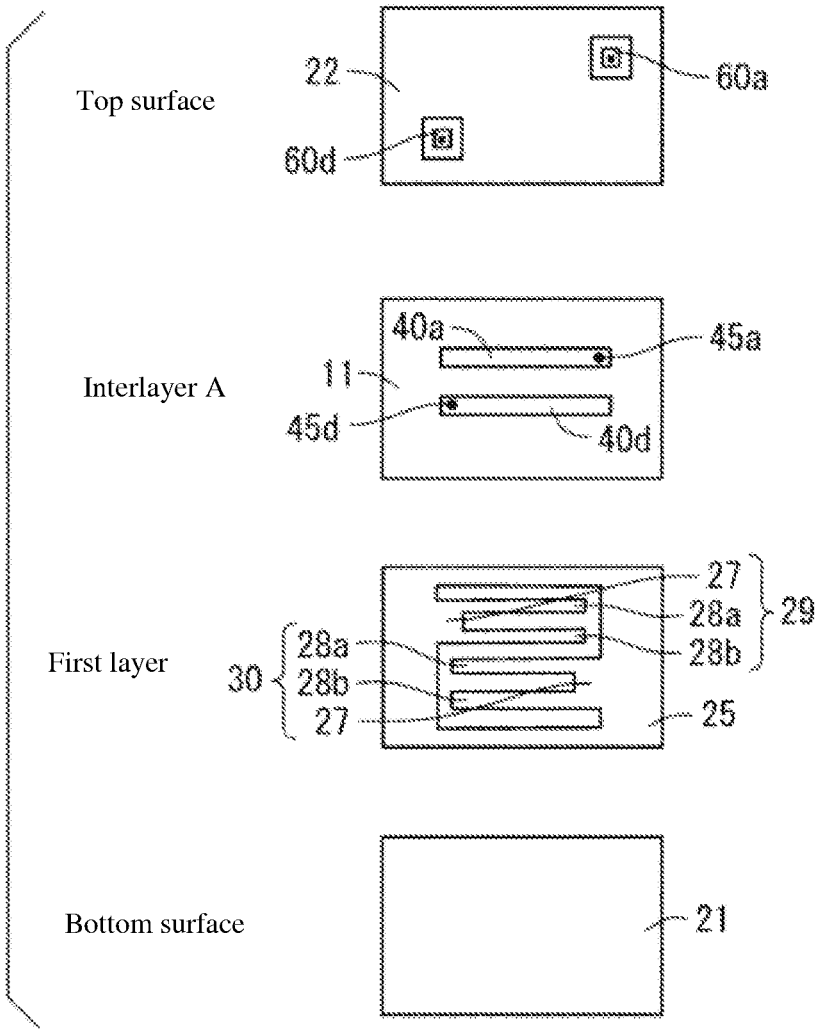
FIG. 8 is a plain view schematically showing the top and bottom surfaces and interlayer of the bandpass filter shown in FIG. 7.

FIG. 7 is an exploded perspective view schematically showing the bandpass filter of the third embodiment of the present invention, and FIG. 8 is a plain view schematically showing the top and bottom surfaces and interlayer of the bandpass filter shown in FIG. 7.

In addition, in this embodiment, only aspects different from the abovementioned second embodiment will be explained so as to omit redundant explanations, and the same reference characters are used for similar components.

In the bandpass filter of this embodiment, as shown in FIG. 7 and FIG. 8, one end and the other end of both the complex resonance electrode on the input stage 29 and the complex resonance electrode on the output stage 30 that comprise the same structure and function as the complex resonance electrode 26 in the second embodiment are disposed side by side so as to alternate and become electromagnetically coupled to each other on the first interlayer of the laminated body, the input coupling electrode 40*a* is disposed to be electromagnetically coupled so as to face against the protruding members on the input stage 28*a* on the complex resonance electrode on the input stage 29, and the output coupling electrode 40*d* is disposed to be electromagnetically coupled so as to face against the protruding members on the output stage 28*b* on the complex resonance electrode on the output stage 30.

In the bandpass filter of this embodiment having such a structure, when electrical signals are input from an external circuit into the electrical signal input point 45*a* of the input coupling electrode 40*a* via the input terminal electrode 60*a* and the through-conductors 50*a*, the complex resonance electrode on the input stage 29 electromagnetically coupled to the input coupling electrode 40*a* and the complex resonance electrode on the output stage 30 electromagnetically coupled thereto resonate, and electrical signals are output to the external circuit from electrical signal output point 45*d* of the output coupling electrode 40*d* electromagnetically coupled to the complex resonance electrode on the output stage 30 via the through-conductors 50*d* and the output terminal electrode 60*d*. At this time, because signals in the frequency band including the first frequency and the second frequency where the complex resonance electrode on the input stage 29 and the complex resonance electrode on the output stage 30 resonate are selectively passed, it functions as a bandpass filter.

The bandpass filter of this embodiment comprises a plurality of complex resonance electrodes 29, 30, where one end and the other end thereof are disposed side by side so as to alternate and become electromagnetically coupled to each other on the first interlayer of the laminated body. In this way, depending on the number of complex resonance electrodes, many resonance peaks can be obtained. Additionally, because the complex resonance electrodes 29, 30 are electromagnetically coupled to each other in an inter-digital form, coupling via the magnetic field and coupling via the electric field are added so as to electromagnetically-couple the electrodes to each other strongly, resulting in a large frequency spacing between each of the resonance peaks. With these effects, a bandpass filter having a substantially wide passband can be easily obtained.

Additionally, the bandpass filter of this embodiment comprises a belt-like input coupling electrode 40*a* electromagnetically coupled so as to face against the protruding members on the input stage 28*a* on the complex resonance electrode on the input stage 29, which is disposed on an interlayer different from the interlayer where the complex resonance electrode 29, 30 of the laminated body is disposed, and a belt-like output coupling electrode 40*d* electromagnetically coupled so as to face against the protruding members on the output stage 28*b* on the complex resonance electrode on the output stage 30, which is disposed on an interlayer different from the interlayer where the complex resonance electrode 29, 30 of the laminated body is disposed. As a result, the input coupling electrode 40*a* and the complex resonance electrode on the input stage 29 are electromagnetically coupled strongly via broadside coupling, and the output coupling electrode 40*d* and the complex resonance electrode on the output stage 30 are electromagnetically coupled strongly via broadside coupling, and therefore, a bandpass filter having flat and low-loss bandpass characteristics across the substantially wide passband can be obtained.

Furthermore, according to the bandpass filter of this embodiment, on the input coupling electrode 40*a*, the electrical signal input point 45*a* is located on a side closer to the other end of the complex resonance electrode on the input stage 29 than the center of a portion facing against the complex resonance electrode on the input stage 29, and on the output coupling electrode 40*d*, the electrical signal output point 45*d* is located on a side closer to the other end of the complex resonance electrode on the output stage 30 than the center of a portion facing against the complex resonance electrode on the output stage 30. As a result, because the input coupling electrode 40*a* and the complex resonance electrode on the input stage 29 are electromagnetically coupled in an inter-digital form, coupling via the magnetic field and coupling via the electric field are added so as to electromagnetically-couple the electrodes to each other strongly, and because the output coupling electrode 40*d* and the complex resonance electrode on the output stage 30 are electromagnetically coupled in an inter-digital form, coupling via the magnetic field and coupling via the electric field are added so as to electromagnetically-couple the electrodes to each other strongly, and therefore, a bandpass filter having flatter and lower-loss bandpass characteristics can be obtained across the substantially wide passband.

Fourth Embodiment

Figure 9:
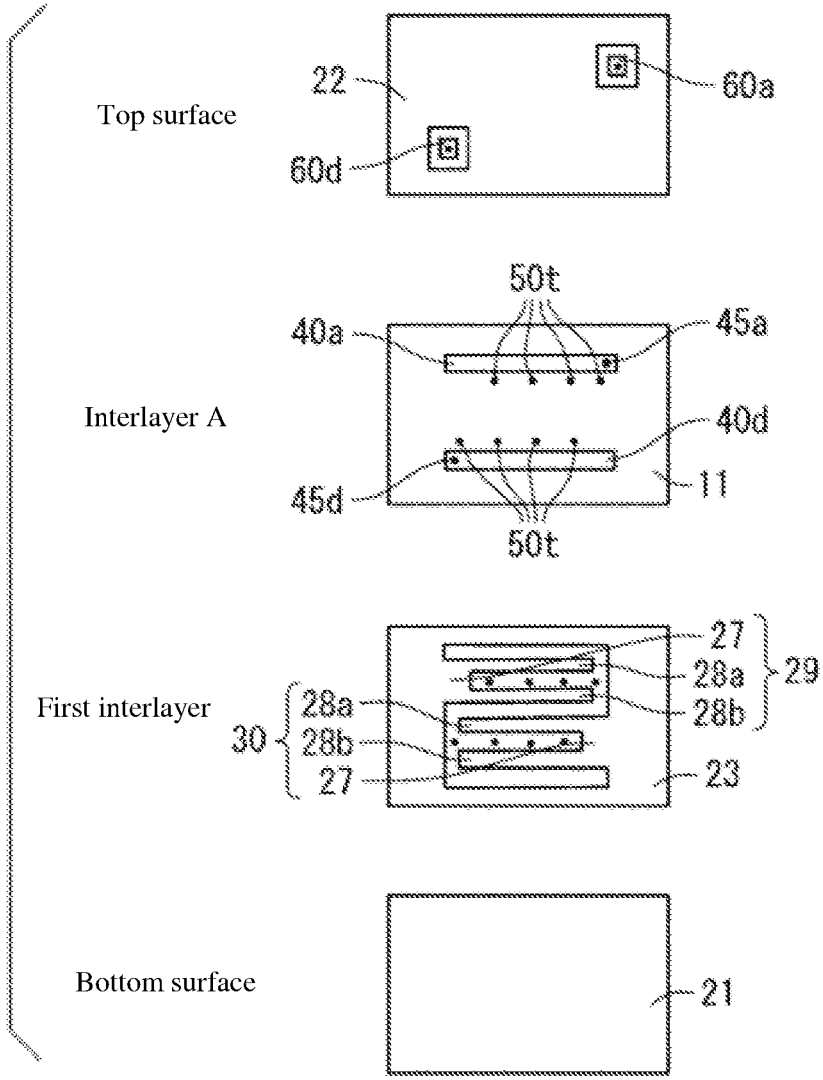
FIG. 9 is a plain view schematically showing the top and bottom surfaces and interlayer of the bandpass filter according to the fourth embodiment of the present invention.

FIG. 9 is a plain view schematically showing the top and bottom surfaces and interlayer of the bandpass filter of the fourth embodiment of the present invention. In addition, in this embodiment, only aspects different from the abovementioned third embodiment will be explained so as to omit redundant explanations, and the same reference characters are used for similar components.

The bandpass filter of this embodiment, as shown in FIG. 9, comprises a structure where a plurality of through-conductors 50*t* is disposed so as to penetrate the laminated body at a location between the protruding members on the input stage 28*a* and the protruding members on the output stage 28*b* on the complex resonance electrode on the input stage 29 and the complex resonance electrode on the output stage 30, and the two ends thereof are respectively connected to the first ground electrode 21 and the second ground electrode 22.

According to the bandpass filter of this embodiment comprising such a structure, the grounded through-conductors 50*t* allow direct electromagnetic coupling between the input coupling electrode 40*a* and output coupling electrode 40*d* to be substantially small, and therefore, a bandpass filter having excellent bandpass characteristics with increased attenuation in frequency regions other than the passband can be obtained.

Figure 10:
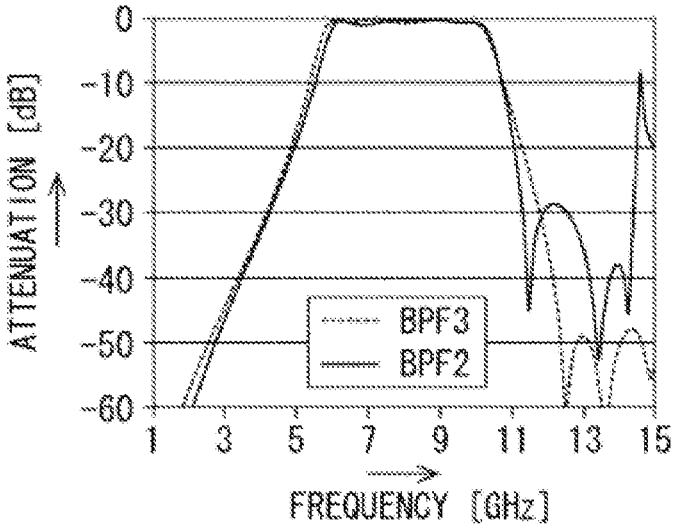
FIG. 10 is a diagram showing simulation results of the electrical characteristics of the bandpass filter according to the third and fourth embodiments of the present invention.

FIG. 10 is a graph showing simulation results of the electrical characteristics of the bandpass filter (BPF2) of the third embodiment having the structure shown in FIG. 7 and the bandpass filter (BPF3) of the fourth embodiment having the structure shown in FIG. 8 and FIG. 9. In the graph, the horizontal axis indicates frequency and the vertical axis indicates attenuation, showing the bandpass characteristics (S21) of the bandpass filters, wherein the input terminal electrode 60*a* is port 1 and the output terminal electrode 60*d* is port 2. According to the graph shown in FIG. 10, in both bandpass filters, flat and low-loss bandpass characteristics are obtained across the substantially wide passband width approximately 50% of the fractional bandwidth at around 6 GHz to 10 GHz, where the effectiveness of the present invention was observed. Additionally, based on the fact that attenuation of the bandpass filter of the fourth embodiment increases by up to approximately 20 dB in the frequency regions on the radio-frequency side relative to the passband as compared to the bandpass filter of the third embodiment, the plurality of through-conductors 50*t* on the bandpass filter of the fourth embodiment was observed to have improved the bandpass characteristics of the bandpass filter.

In this simulation, the complex resonance electrode on the input stage 29 and the complex resonance electrode on the output stage 30 are strutted so that the rectangular protruding members on the input stage 28*a* and protruding members on the output stage 28*b* that are 0.25 mm in width and 2.15 mm in length are disposed 0.6-mm apart from the other end of the rectangular base member 27 that is 1.05 mm in width and 0.9 mm in length and are disposed side by side spaced 0.21-mm apart so that each one end and the other end are alternated. The input coupling electrode 40*a* and the output coupling electrode 40*d* are made into a rectangle 0.25 mm in width and 3.0 mm in length. The input terminal electrode 60*a* and the output terminal electrode 60*d* are made into a square that is 0.3 mm on each side. The outlines of the first ground electrode 21, the second ground electrode 22, and the annular ground electrode 25 are made into a rectangle 5.0 mm in length and 4.5 mm in width, and the opining of the annular ground electrode 25 is made into a rectangle 3.7 mm in width and 3.25 mm in length. The entire shape of the bandpass filter is made into a rectangular parallelepiped 5.0 mm in length, 4.5 mm in width, and 0.98 mm in thickness so that the complex resonance electrodes 29, 30 are located at the center in the thickness direction. The space between the interlayer where the complex resonance electrode 29, 30 are disposed and the interlayer where the input coupling electrode 40*a* and the output coupling electrode 40*d* are disposed (the space between various types of electrodes disposed on respective interlayer) is made to be 0.065 mm. The thickness of the various types of electrode is made to be 0.01 mm and the diameter of the through-conductors 50*a*, 50*d*, 50*t* is made to be 0.1 mm. The relative permittivity of the dielectric layers 11 is made to be 9.45.

Fifth Embodiment

Figure 11:
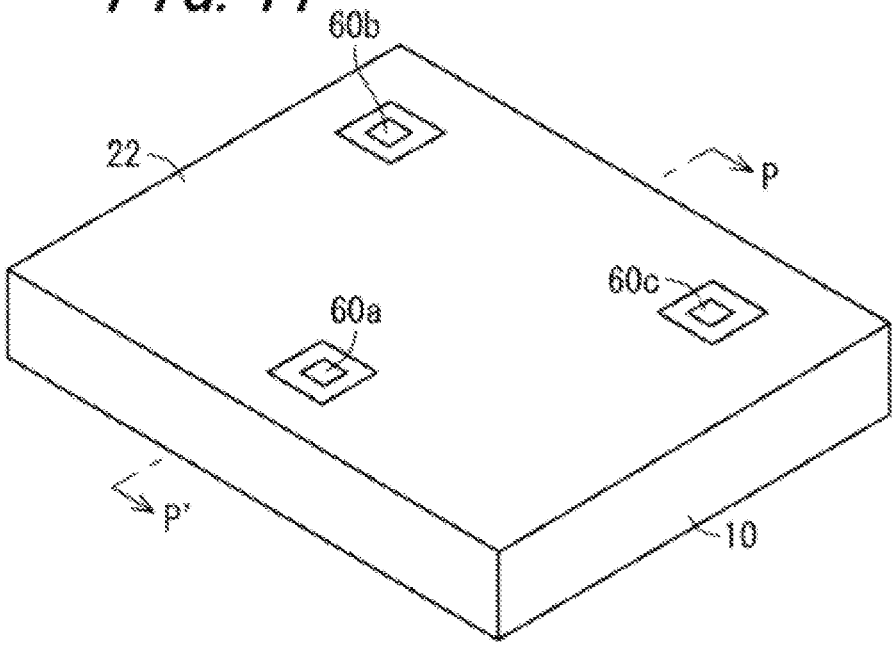
FIG. 11 is an external perspective view schematically showing the diplexer according to the fifth embodiment of the present invention.
Figure 12:
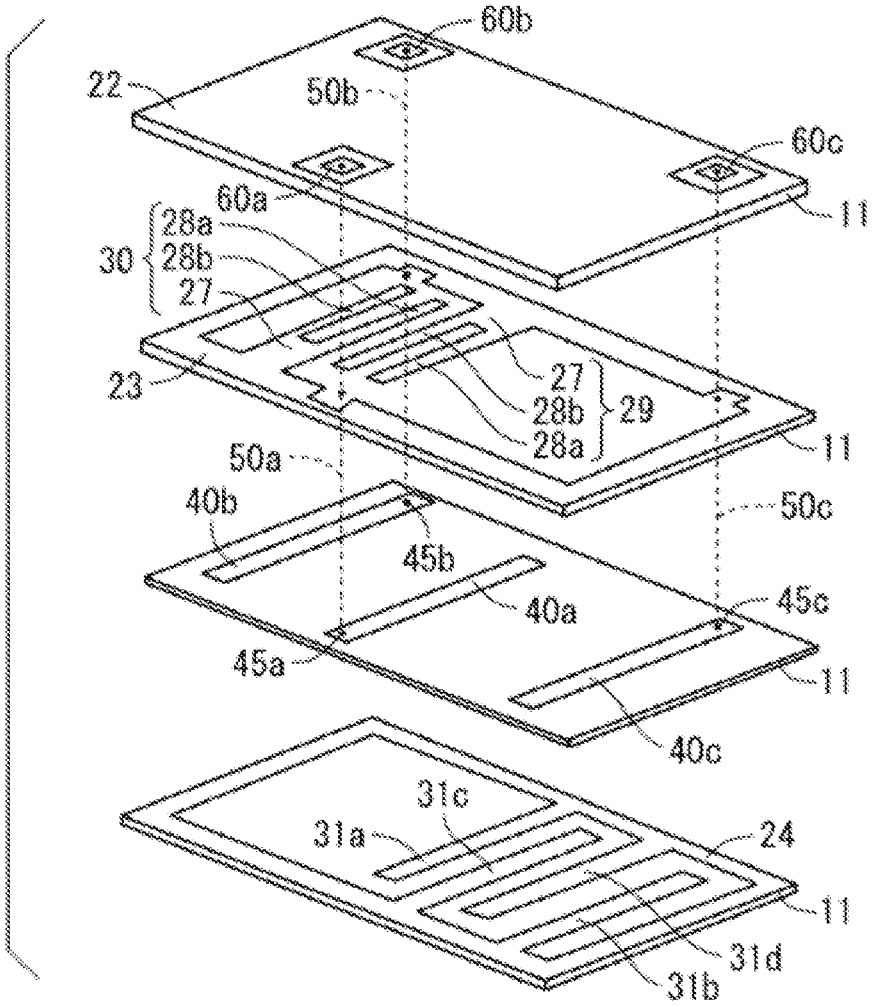
FIG. 12 is a schematic exploded perspective view of the diplexer shown in FIG. 11.
Figure 13:
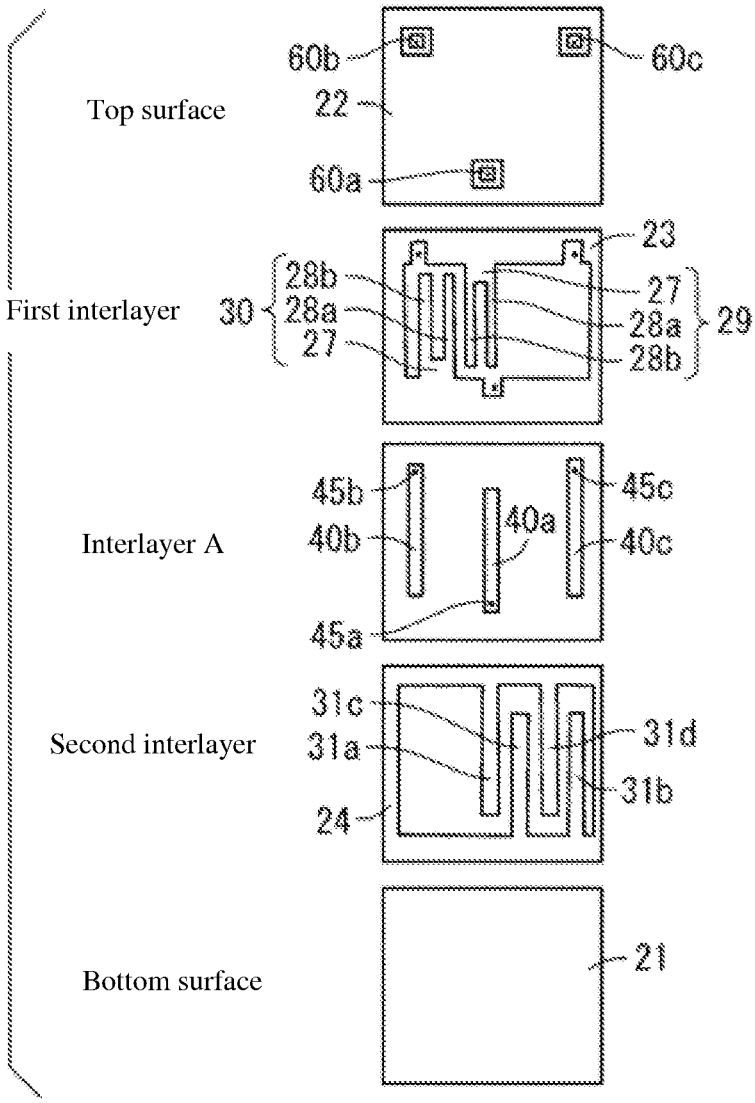
FIG. 13 is a plain view schematically showing the top and bottom surfaces and interlayer the diplexer shown in FIG. 11.
Figure 14:
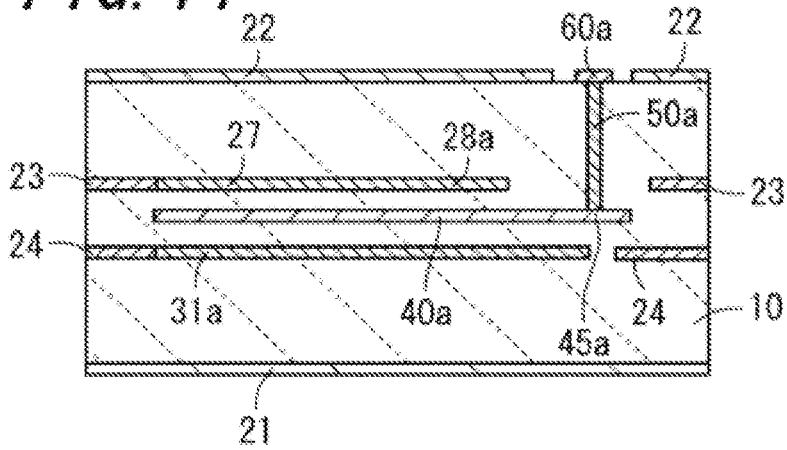
FIG. 14 is a cross-sectional view taken from the line P-P' in FIG. 11.

FIG. 11 is an external perspective view schematically showing the diplexer according to the fifth embodiment of the present invention. FIG. 12 is a schematic exploded perspective view of the diplexer shown in FIG. 11. FIG. 13 is a plain view schematically showing the top and bottom surfaces and interlayer of the diplexer shown in FIG. 11. FIG. 14 is a cross-sectional view taken from the line P-P' in FIG. 11.

In addition, in this embodiment, only aspects different from the abovementioned third embodiment will be explained so as to omit redundant explanations, and the same reference characters are used for similar components.

The diplexer of this embodiment, as shown in FIG. 11 to FIG. 14, comprises a laminated body 10, a first ground electrode 21, a second ground electrode 22, a plurality of complex resonance electrodes 29, 30, and a plurality of belt-like single resonance electrodes 31*a*, 31*b*, 31*c*, 31*d*. In each complex resonance electrode 29, 30, one end is grounded, resulting in the entire body combining a base member 27 with protruding members 28*a*, 28*b* functioning as a resonator that resonates at a first frequency, and protruding members 28*a*, 28*b* functioning as a resonator that resonates at a second frequency higher than the first frequency. One end and the other end of the plurality of complex resonance electrodes 29, 30 are disposed side by side on the first interlayer of the laminated body 10 so as to alternate and become electromagnetically coupled to each other. The plurality of single resonance electrodes s 31*a*, 31*b*, 31*c*, 31*d* is disposed side by side on a second interlayer different from the first interlayer of the laminated body 10 so as to be electromagnetically coupled to each other and functions as a resonator where each one end is grounded and resonates at a third frequency different from the first frequency and the second frequency. In addition, in the diplexer of this embodiment, the third frequency is set to be lower than the first frequency.

Additionally, the diplexer of this embodiment comprises a belt-like input coupling electrode 40*a*, a belt-like first output coupling electrode 40*b*, and a belt-like second output coupling electrode 40*c*. The input coupling electrode 40*a* has an electrical signal input point 45*a* that is disposed on the interlayer A located between the first interlayer and the second interlayer of the laminated body 10, is electromagnetically coupled so as to face against the protruding members on the input stage 28*a* of a plurality of protruding members 28*a*, 28*b* on the complex resonance electrode on the input stage 29 of a plurality of complex resonance electrodes 29, 30, is electromagnetically coupled so as to face against a single resonance electrode on the input stage 31*a* of a plurality of single resonance electrodes 31*a*, 31*b*, 31*c*, 31*d*, and into which electrical signals are input. The first output coupling electrode 40*b* has a first electrical signal output point 45*b*, which is located on the interlayer A different from the first interlayer of the laminated body 10, is electromagnetically coupled so as to face against the protruding members on the output stage 28*b* of a plurality of protruding members 28*a*, 28*b* on the complex resonance electrode on the output stage 30 of a plurality of complex resonance electrodes 29, 30, and from which electrical signals are output. The second output coupling electrode 40*c* has a second electrical signal output point 45*c*, which is disposed on the interlayer A different from the second interlayer of the laminated body 10, is electromagnetically coupled so as to face against the single resonance electrode on the output stage 31*b* of a plurality of single resonance electrodes 31*a*, 31*b*, 31*c*, 31*d*, and from which electrical signals are output.

Furthermore, the diplexer of this embodiment comprises a first annular ground electrode 23, which is formed into an annular shape so as to surround the circumference of the plurality of complex resonance electrodes 29, 30 on the first interlayer of the laminated body 10 and to which one end of each of the plurality of complex resonance electrodes 29, 30 is connected, and a second annular ground electrode 24, which is formed into an annular shape so as to surround the circumference of a plurality of single resonance electrodes s 31*a*, 31*b*, 31*c*, 31*d* on the second interlayer and to which one end of each of the plurality of single resonance electrodes s 31*a*, 31*b*, 31*c*, 31*d* is connected.

Furthermore, the input coupling electrode 40*a* is connected to the input terminal electrode 60*a* disposed on the top surface of the laminated body 10 via the through-conductors 50*a*, the first output coupling electrode 40*b* is connected to the first output terminal electrode 60*b* disposed on the top surface of the laminated body 10 via the through-conductors 50*b*, and the second output coupling electrode 40*c* is connected to the second output terminal electrode 60*c* disposed on the top surface of the laminated body 10 via the through-conductors 50*c*. Accordingly, the connection point between the input coupling electrode 40*a* and the through-conductors 50*a* becomes an electrical signal input point 45*a* into which electrical signals are input to the input coupling electrode 40*a*, the connection point between the first output coupling electrode 40*b* and the through-conductors 50*b* becomes a first electrical signal output point 45*b* from which electrical signals are output from the first output coupling electrode 40*b*, and the connection point between the second output coupling electrode 40*c* and the through-conductors 50*c* becomes a second electrical signal output point 45*c* from which electrical signals are output from the second output coupling electrode 40*c*.

In the diplexer of this embodiment comprising such a configuration, when electrical signals are input from an external circuit into the electrical signal input point 45*a* of the input coupling electrode 40*a* via the input terminal electrode 60*a* and the through-conductors 50*a*, the complex resonance electrode on the input stage 29 electromagnetically coupled to the input coupling electrode 40*a* is excited, a plurality of complex resonance electrodes 29, 30 electromagnetically coupled to each other resonates, and electrical signals are thus output to the external circuit from the first electrical signal output point 45*b* of the first output coupling electrode 40*b* electromagnetically coupled to the complex resonance electrode on the output stage 30 via the through-conductors 50*b* and the first output terminal electrode 60*b*. At this time, signals of the first frequency band including the frequency where the plurality of complex resonance electrodes 29, 30 resonate are selectively passed, and the first passband is thereby formed.

Additionally, in the diplexer of this embodiment, when electrical signals are input from the external circuit into the electrical signal input point 45*a* of the input coupling electrode 40*a* via the input terminal electrode 60*a* and the through-conductors 50*a*, a single resonance electrode on the input stage 31*a* electromagnetically coupled to the input coupling electrode 40*a* is excited, a plurality of single resonance electrodes 31*a*, 31*b*, 31*c*, 31*d* electromagnetically coupled to each other resonates, and electrical signals are thus output to the external circuit from the second electrical signal output point 45*c* of the second output coupling electrode 40*c* electromagnetically coupled to a single resonance electrode on the output stage 31*b* via the through-conductors 50*c* and the second output terminal electrode 60*c*. At this time, signals of the second frequency band including the frequency where the plurality of single resonance electrodes s 31*a*, 31*b*, 31*c*, 31*d* resonate are selectively passed, and the second passband is thereby formed.

In this way, the diplexer of this embodiment functions as a diplexer that diplexers signals depending on the frequency input from the input terminal electrode 60*a* and output from the first output terminal electrode 60*b* and second output terminal electrode 60*c*.

In the diplexer of this embodiment, and the first ground electrode 21 is disposed on the entire surface of the bottom surface of the laminated body 10, the second ground electrode 22 is disposed on almost the entire surface excluding the circumference of the input terminal electrode 60*a*, the first output terminal electrode 60*b*, and the second output terminal electrode 60*c* of the top surface of the laminated body 10, where both are grounded and composed of a stripline resonator with a plurality of complex resonance electrodes 29, 30 and a plurality of single resonance electrodes 31*a*, 31*b*, 31*c*, 31*d*. Additionally, the first annular ground electrode 23 and the second annular ground electrode 24 themselves are grounded, resulting in their functioning to ground one end of each of the complex resonance electrodes 29, 30 and the plurality of single resonance electrodes 31*a*, 31*b*, 31*c*, 31*d* and preventing the leaking of electromagnetic waves generated from the complex resonance electrode 29, 30 and the plurality of single resonance electrodes 31*a*, 31*b*, 31*c*, 31*d* to the surrounding area. This function is specifically useful when a diplexer is formed within a region in a substrate such as a module substrate.

Additionally, one end of the complex resonance electrodes 29, 30 (i.e., one end of the base member 27) is grounded, resulting in their functioning basically as a ¼ wavelength resonator where the entire body combining the base member 27 with the protruding members 28*a*, 28*b* resonates at the first frequency, and also functioning as a ¼ wavelength resonator where the protruding members 28*a*, 28*b* resonate at the second frequency higher than the first frequency. Accordingly, the length of the entire body combining the base member 27 with the protruding members 28*a*, 28*b* is approximately equivalent to ¼ of the wavelength at the first frequency, and the length of the protruding members 28*a*, 28*b* is approximately equivalent to ¼ of the wavelength at the second frequency. The length of the protruding members 28*a* and the protruding members 28*b* is basically set to be equivalent, but there may be cases in which the length varies depending on the coupled state with the other electrodes, etc. Additionally, although the number of the protruding members may be 3 or more, for minimizing the size, 2 is better.

In the plurality of belt-like single resonance electrodes 31*a*, 31*b*, 31*c*, 31*d*, one end of each is connected to the second annular ground electrode 24 to be grounded, resulting in their functioning as a ¼ wavelength resonator that resonates at the third frequency. In turn, the electric length of each is set to be approximately ¼ of the wavelength at the third frequency.

Additionally, a plurality of complex resonance electrodes 29, 30 is disposed side by side on the first interlayer of the laminated body 10 so as to be edge-coupled to each other, and a plurality of single resonance electrodes 31*a*, 31*b*, 31*c*, 31*d* is disposed side by side on the second interlayer of the laminated body 10 so as to be edge-coupled to each other. Stronger coupling can be obtained with smaller spaces between the plurality of complex resonance electrodes 29, 30 and between the plurality of single resonance electrodes 31*a*, 31*b*, 31*c*, 31*d* that are disposed side by side, but if the spaces are made to be small, manufacturing becomes difficult, and therefore, it is set to be, for example, approximately 0.05 to 0.5 mm. In turn, stronger coupling can be obtained with smaller spaces between the input coupling electrode 40*a* and the complex resonance electrode on the input stage 29 and the single resonance electrode on the input stage 31*a* as well as between the first output coupling electrode 40*b* and the complex resonance electrode on the output stage 30 and between the second output coupling electrode 40*c* and the single resonance electrode on the output stage 31*b*, but this makes the manufacturing difficult, and therefore, it is set to be, for example, approximately 0.01 to 0.5 mm.

According to the diplexer of this embodiment, because it comprises the complex resonance electrodes 29, 30, wherein the entire body combining the base member 27 with the protruding members 28*a*, 28*b* functions as a resonator that resonates at a first frequency, and the protruding members 28*a*, 28*b* functions as a resonator that resonates at a second frequency higher than the first frequency, the difference in frequency between the first frequency and the second frequency can be optionally controlled to some degree depending on the length of the protruding members 28*a*, 28*b*, and the width of the passband formed by the complex resonance electrodes 29, 30 can thereby be easily set to a wide and desired width.

Additionally, according to the diplexer of this embodiment, because a plurality of complex resonance electrodes 29, 30 is disposed side by side on the first interlayer of the laminated body 10 so that one end and the other end thereof are alternated and become electromagnetically coupled to each other, many resonance peaks can be obtained, and because a plurality of complex resonance electrodes 29, 30 is electromagnetically coupled to each other in an inter-digital form, coupling via the magnetic field and coupling via the electric field are added so as to electromagnetically couple the electrodes to each other strongly, and therefore, the frequency spacing between each of the resonance peaks can be large and the width of the passband formed by the complex resonance electrodes 29, 30 can be made to be substantially wide.

Furthermore, according to the diplexer of this embodiment, because it comprises an input coupling electrode 40*a* electromagnetically coupled so as to face against with the protruding members on the input stage 28*a* on the complex resonance electrode on the input stage 29 and dielectric layers 11 therebetween, as well as a first output coupling electrode 40*b* electromagnetically coupled so as to face against with the protruding members on the output stage 28*b* on the complex resonance electrode on the output stage 30 and dielectric layers 11 therebetween, the input coupling electrode 40*a* and the complex resonance electrode on the input stage 29 are electromagnetically coupled strongly via broadside coupling, the first output coupling electrode 40*b* and the complex resonance electrode on the output stage 30 are electromagnetically coupled strongly via broadside coupling, and as a result, a diplexer having flat and low-loss bandpass characteristics can be obtained across the substantially wide passband formed by the complex resonance electrodes 29, 30.

Furthermore, according to the diplexer of this embodiment, on the input coupling electrode 40*a*, the electrical signal input point 45*a* is located on a side closer to the other end of the complex resonance electrode on the input stage 29 than the center of a portion facing against the complex resonance electrode on the input stage 29, and on the first output coupling electrode 40*b*, the first electrical signal output point 45*b* is located on a side closer to the other end of the complex resonance electrode on the output stage 30 than the center of a portion facing against the complex resonance electrode on the output stage 30, and therefore, the input coupling electrode 40*a* and the complex resonance electrode on the input stage 29 are electromagnetically coupled in an inter-digital form, coupling via the magnetic field and coupling via the electric field are added so as to electromagnetically couple the electrodes to each other strongly, the first output coupling electrode 40*b* and the complex resonance electrode on the output stage 30 are electromagnetically coupled in an inter-digital form, coupling via the magnetic field and coupling via the electric field are added so as to electromagnetically couple the electrodes to each other strongly, and a diplexer having flatter and lower-loss bandpass characteristics can thus be obtained across the substantially wide passband formed by the complex resonance electrodes 29, 30.

In addition, according to the diplexer of this embodiment, because one end of the complex resonance electrode on the input stage 29 and one end of the single resonance electrode on the input stage 31*a* are located on the same side, the input coupling electrode 40*a* and the complex resonance electrode on the input stage 29 and the single resonance electrode on the input stage 31*a* can be broadside-coupled and coupled in an inter-digital form in this way.

Furthermore, according to the diplexer of this embodiment, on the input coupling electrode 40*a*, the electrical signal input point 45*a* is located on a side closer to the other end of the single resonance electrode on the input stage 31*a* than the center of a portion facing against a single resonance electrode on the input stage 31*a*, and on the second output coupling electrode 40*c*, the second electrical signal output point 45*c* is located on a side closer to the other end of the single resonance electrode on the output stage 31*b* than the center of a portion facing against the single resonance electrode on the output stage 31*b*, the input coupling electrode 40*a* and the single resonance electrode on the input stage 31*a* are electromagnetically coupled in an inter-digital form, coupling via the magnetic field and coupling via the electric field are added so as to electromagnetically couple the electrodes to each other strongly, the first output coupling electrode 40*b* and the single resonance electrode on the output stage 31*b* are electromagnetically coupled in an inter-digital form, coupling via the magnetic field and coupling via the electric field are added so as to electromagnetically couple the electrodes to each other strongly, and a diplexer having flatter and lower-loss bandpass characteristics can thus be obtained across the substantially wide passband formed by a plurality of single resonance electrodes 31*a*, 31*b*, 31*c*, 31*d*.

Furthermore, according to the diplexer of this embodiment, it is possible to prevent the exacerbation of isolation between the first output coupling electrode 40*b* and the second output coupling electrode 40*c* occurring due to the fact that the complex resonance electrodes 29, 30 and the single resonance electrodes 31*a*, 31*b*, 31*c*, 31*d* are directly electromagnetically coupled. This is believed to be because the shapes of the complex resonance electrodes 29, 30 and the single resonance electrodes 31*a*, 31*b*, 31*c*, 31*d* are different, and therefore, it is difficult to electromagnetically couple the complex resonance electrodes 29, 30 with the single resonance electrodes 31*a*, 31*b*, 31*c*, 31*d*.

Furthermore, according to the diplexer of this embodiment, because the first output coupling electrode 40*b* and the second output coupling electrode 40*c* are, when viewed planarly, located on opposite sides from each other with the input coupling electrode 40*a* located therebetween, it can further prevent the exacerbation of isolation between the first output coupling electrode 40*b* and the second output coupling electrode 40*c* caused by the electromagnetic coupling between the first output coupling electrode 40*b* and the second output coupling electrode 40*c*.

Furthermore, according to the diplexer of this embodiment, the complex resonance electrode on the input stage 29 and the single resonance electrode on the input stage 31*a* are faced against each other with the input coupling electrode 40*a* located therebetween, and the other complex resonance electrode 30 and the single resonance electrodes 31*b*, 31*c*, 31*d* are disposed apart therefrom on opposite sides.

As a result, the input coupling electrode 40*a* and the complex resonance electrode on the input stage 29 and the single resonance electrode on the input stage 31*a* are broadside-coupled, and also, the isolation between the plurality of complex resonance electrodes 29, 30 and the plurality of single resonance electrodes 31*a*, 31*b*, 31*c*, 31*d* can be secured to the maximum extent. Accordingly, a diplexer in which both of two wide passbands have flat and low-loss bandpass characteristics and in which the isolation between the first output terminal electrode 60*b* and the second output terminal electrode 60*c* is sufficiently secured can be obtained.

Sixth Embodiment

Figure 15:
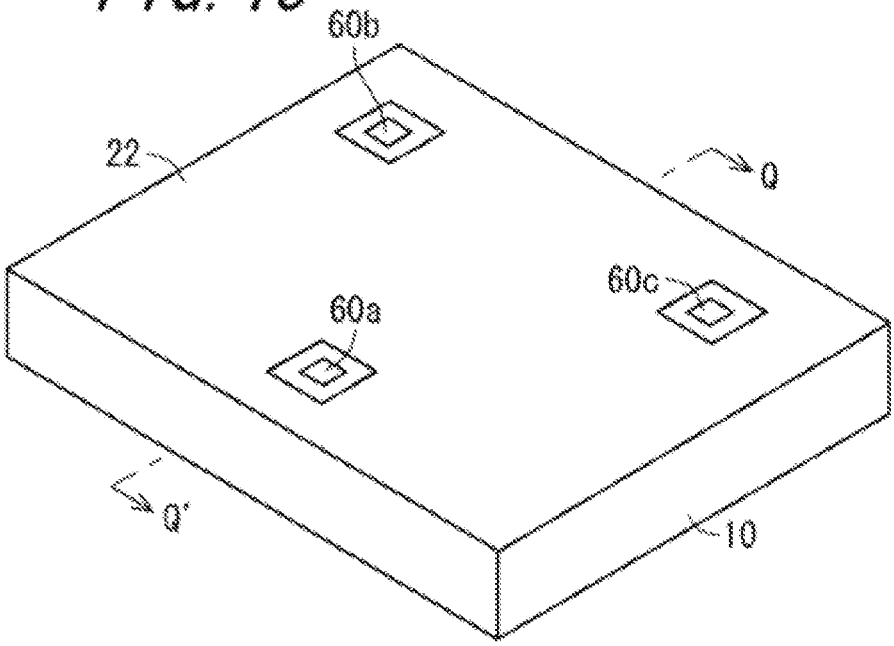
FIG. 15 is an external perspective view schematically showing the diplexer according to the sixth embodiment of the present invention.
Figure 16:
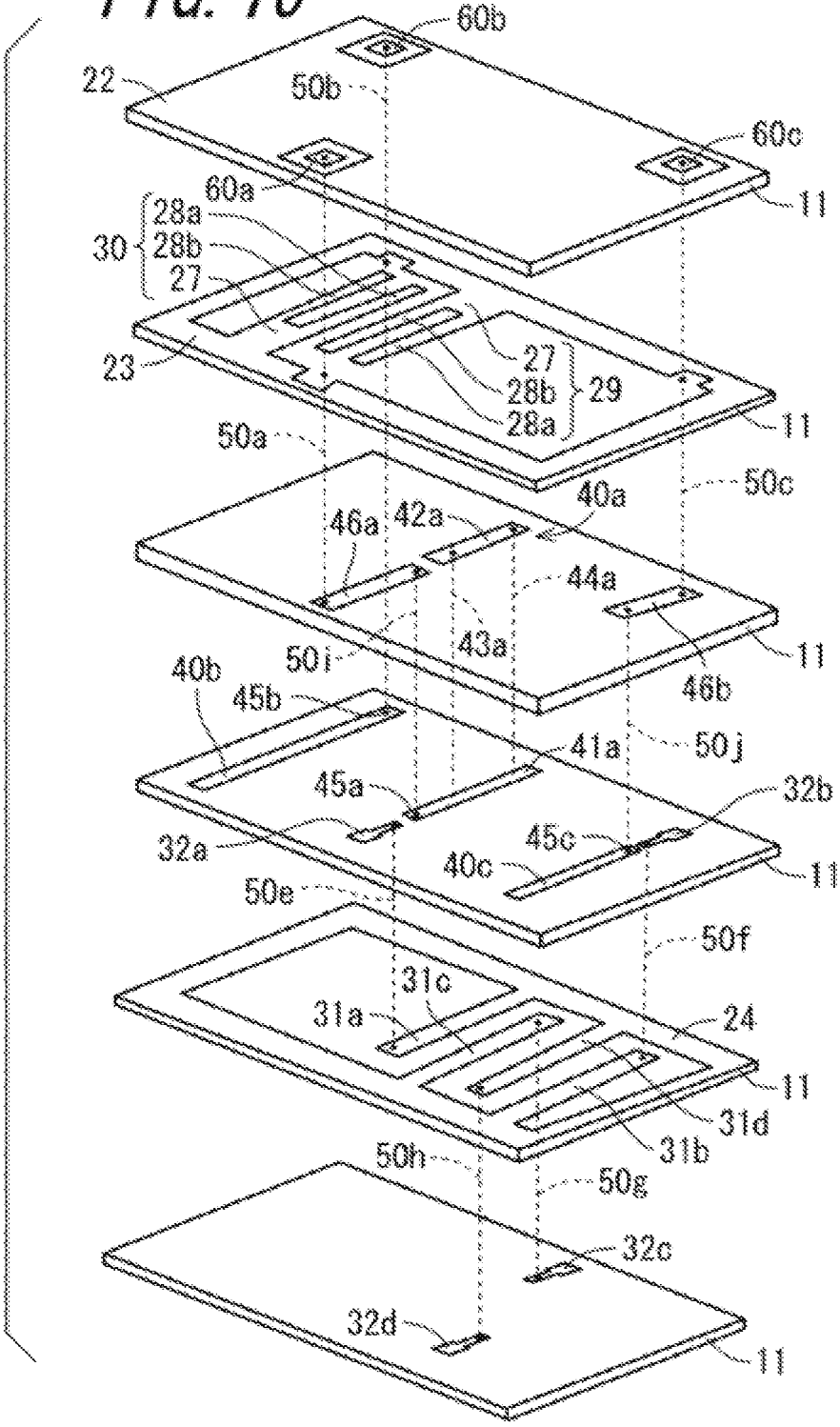
FIG. 16 is a schematic exploded perspective view of the diplexer shown in FIG. 15.
Figure 17:
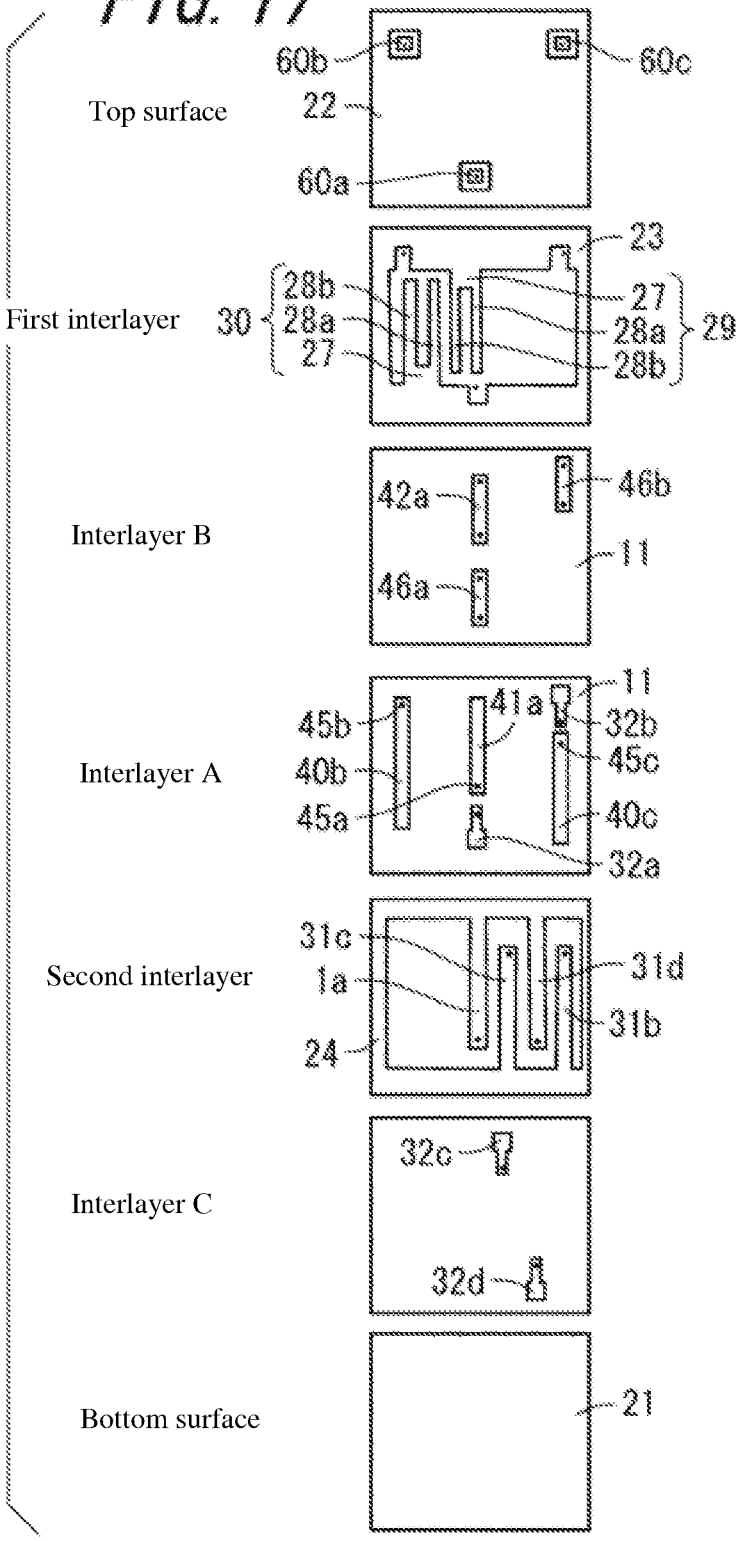
FIG. 17 is a plain view schematically showing the top and bottom surfaces and interlayer of the diplexer shown in FIG. 15.
Figure 18:
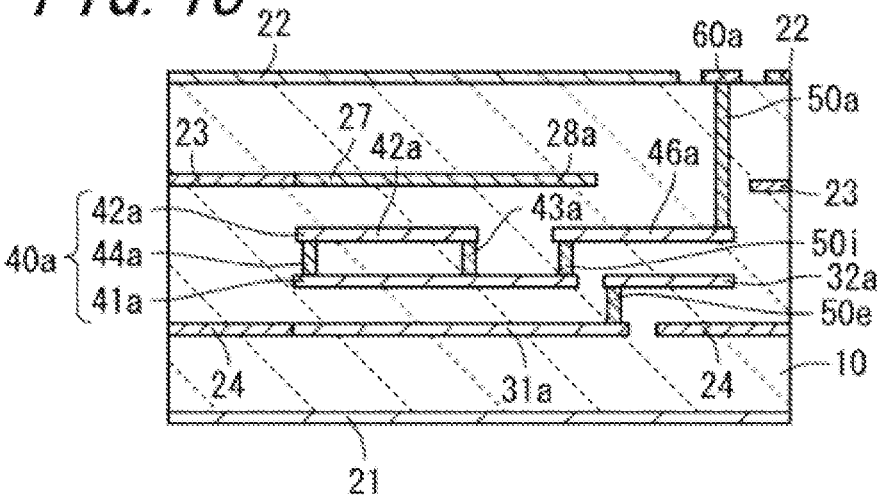
FIG. 18 is a cross-sectional view taken from the line Q-Q' in FIG. 15.

FIG. 15 is an external perspective view schematically showing the diplexer according to the sixth embodiment of the present invention. FIG. 16 is a schematic exploded perspective view of the diplexer shown in FIG. 15. FIG. 17 is a plain view schematically showing the top and bottom surfaces and interlayer of the diplexer shown in FIG. 15. FIG. 18 is a cross-sectional view taken from the line Q-Q' in FIG. 15.

In addition, in this embodiment, only aspects different from the abovementioned fifth embodiment will be explained so as to omit redundant explanations, and the same reference characters are used for similar components.

In the diplexer of this embodiment, as shown in FIG. 15 to FIG. 18, the input coupling electrode 40*a* includes a belt-like first input coupling conductor 41*a*, a belt-like second input coupling conductor 42*a*, an input-side connecting conductor 43*a*, and an input-side connecting auxiliary conductor 44*a*. The first input coupling conductor 41*a* is disposed on the interlayer A located between the first interlayer of the laminated body 10 and the second interlayer so as to face against the single resonance electrode on the input stage 31*a*. The second input coupling conductor 42*a* is disposed on the interlayer B located between the first interlayer of the laminated body 10 and the interlayer A so as to face against the protruding members on the input stage 28*a* of the complex resonance electrode on the input stage 29. The input-side connecting conductor 43*a* and the input-side connecting auxiliary conductor 44*a* connect the first input coupling conductor 41*a* and the second input coupling conductor 42*a*. With this configuration, as compared to the case in which the input coupling electrode 40*a* is one layer of electrodes, the space between the input coupling electrode 40*a* and the complex resonance electrode on the input stage 29 and the single resonance electrode on the input stage 31*a* is maintained, while the space between the complex resonance electrode on the input stage 29 and the single resonance electrode on the input stage 31*a* can be widened. Therefore, without weakening the electromagnetic coupling between the input coupling electrode 40*a* and both the complex resonance electrode on the input stage 29 and the single resonance electrode on the input stage 31*a*, direct electromagnetic coupling between the complex resonance electrode on the input stage 29 and the single resonance electrode on the input stage 31*a* can be weakened. As a result, the electromagnetic coupling between the input coupling electrode 40*a* and both the complex resonance electrode on the input stage 29 and the single resonance electrode on the input stage 31*a* can be further strengthened.

Furthermore, according to the diplexer of this embodiment, because the electrical signal input point 45*a* is disposed on the opposite side of the input-side connecting conductor 43*a* from the center of the facing regions of the first input coupling conductor 41*a* and the second input coupling conductor 42*a*, the electromagnetic coupling between the input coupling electrode 40*a* and both the complex resonance electrode on the input stage 29 and the single resonance electrode on the input stage 31*a* can be further strengthened. This mechanism is assumed to occur due to the fact that the first input coupling conductor 41*a* and the second input coupling conductor 42*a* are connected by the input-side connecting auxiliary conductor 44*a*, the difference in potential between the first input coupling conductor 41*a* and the second input coupling conductor 42*a* becomes small around the open end of the input coupling electrode 40*a*, the electromagnetic coupling between the first input coupling conductor 41*a* and the second input coupling conductor 42*a* becomes weak, the electromagnetic coupling between the first input coupling conductor 41*a* and the single resonance electrode on the input stage 31*a* becomes strong, and the electromagnetic coupling between the second input coupling conductor 42*a* and the complex resonance electrode on the input stage 29 becomes strong.

Furthermore, according to the diplexer of this embodiment, because the input-side connecting auxiliary conductor 44*a* is disposed on the end of the opposite side of the side where the electrical signal input point 45*a* and the input-side connecting conductor 43*a* are disposed towards the center of the facing regions, the difference in potential between the first input coupling conductor 41*a* and the second input coupling conductor 42*a* can be minimized around the open end of the input coupling electrode 40*a*, and the electromagnetic coupling between the input coupling electrode 40*a* and both the complex resonance electrode on the input stage 29 and the single resonance electrode on the input stage 31*a* can thus be further strengthened.

Furthermore, according to the diplexer of this embodiment, because the input-side connecting conductor 43*a* and the input-side connecting auxiliary conductor 44*a* are disposed on both ends of focusing regions of the first input coupling conductor 41*a* and the second input coupling conductor 42*a*, the potentials of each can be made close across the facing regions of the first input coupling conductor 41*a* and the second input coupling conductor 42, and therefore, the electromagnetic coupling between the input coupling electrode 40*a* and both the complex resonance electrode on the input stage 29 and the single resonance electrode on the input stage 31*a* can be further strengthened.

Additionally, in the diplexer of this embodiment, on the interlayer A of the laminated body 10, a resonance auxiliary electrode 32*a* on the input stage and a resonance auxiliary electrode 32*b* on the output stage are disposed. The resonance auxiliary electrode 32*a* on the input stage is disposed so as to have a region facing against the second annular ground electrode 24 and is connected to the open end of the single resonance electrode on the input stage 31*a* via the through-conductors 50*e*. The resonance auxiliary electrode 32*b* on the output stage is disposed so as to have a region facing against the second annular ground electrode 24 and is connected to the open end of the single resonance electrode on the output stage 31*b* via the through-conductors 50*f*. In turn, in the interlayer C located lower than the first interlayer of the laminated body 10, the resonance auxiliary electrodes 32*c*, 32*d* are disposed. The resonance auxiliary electrodes 32*c*, 32*d* are disposed so as to have a region facing against the second annular ground electrode 24 and are respectively connected to the other ends of the single resonance electrodes 31*c*, 31*d* via the through-conductors 50*g*, 50*h*. With such a configuration, capacitance occurs between both portions facing against each of the resonance auxiliary electrodes 32*a*, 32*b*, 32*c*, 32*d* and the second annular ground electrode 24 and is added to the capacitance between the single resonance electrodes 31*a*, 31*b*, 31*c*, 31*d*, where the resonance auxiliary electrodes 32*a*, 32*b*, 32*c*, 32*d* are respectively connected, and the ground potential, and the respective lengths of the single resonance electrodes 31*a*, 31*b*, 31*c*, 31*d* are thus shortened and a diplexer with a small size can be obtained.

Here, the area of the portion facing against the resonance auxiliary electrodes 32*a*, 32*b*, 32*c*, 32*d* and the second annular ground electrode 24 is, in view of the necessary size and obtained capacitance, set to be approximately 0.01 to 3 $mm^2$, for example. Greater capacitance can occur when the space between the portion facing against the resonance auxiliary electrodes 32*a*, 32*b*, 32*c*, 32*d* and the second annular ground electrode 24 is smaller, but this makes manufacturing difficult, and therefore, the space is set to be approximately 0.01 to 0.5 mm, for example.

Furthermore, the diplexer of this embodiment comprises an input coupling auxiliary electrode 46*a* and an output coupling auxiliary electrode 46*b* on the interlayer located above the interlayer A of the laminated body 10. The input coupling auxiliary electrode 46*a* is disposed so as to have a region facing against the resonance auxiliary electrode 32*a* on the input stage and is connected to the electrical signal input point 45*a* of the first input coupling conductor 41*a* configuring the input coupling electrode 40*a* via the through-conductors 50*i*. The output coupling auxiliary electrode 46*b* is disposed so as to have a region facing against the resonance auxiliary electrode 32*b* on the output stage and is connected to the second electrical signal output point 45*c* of the second output coupling electrode 40*c* via the through-conductors 50*j*. In turn, the input coupling auxiliary electrode 46*a* is connected to the input terminal electrode 60*a* via the through-conductors 50*a* and the output coupling auxiliary electrode 46*b* is connected to the second output terminal electrode 60*c* via the through-conductors 50*c*. With such a configuration, the electromagnetic coupling that occurs between the resonance auxiliary electrode on the input stage 32*a* and the input coupling auxiliary electrode 46*a* is added to the electromagnetic coupling that occurs between the single resonance electrode on the input stage 31*a* and the input coupling electrode 40*a*. Additionally, similarly, the electromagnetic coupling that occurs between the resonance auxiliary electrode on the output stage 32*b* and the output coupling auxiliary electrode 46*b* is added to the electromagnetic coupling that occurs between the single resonance electrode on the output stage 31*b* and the second output coupling electrode 40*c*. As a result, the electromagnetic coupling between the input coupling electrode 40*a* and the single resonance electrode on the input stage 31*a* and the electromagnetic coupling between the second output coupling electrode 40*c* and the single resonance electrode on the output stage 31*b* can be further strengthened.

In this way, according to the diplexer of this embodiment, because the input coupling electrode 40*a* and both the complex resonance electrode on the input stage 29 and the single resonance electrode on the input stage 31*a* are electromagnetically coupled in a substantially strong manner, the first output coupling electrode 40*b* and the complex resonance electrode on the output stage 30 are substantially strongly electromagnetically coupled, and the second output coupling electrode 40*c* and the single resonance electrode on the output stage 31*b* are electromagnetically coupled in a substantially strong manner, flat and low-loss bandpass characteristics with reduced return loss and less increased insertion loss due to mismatching of the input impedance can be obtained even at frequencies located among the resonance frequencies in each of the resonance modes across the substantially wide two passbands formed by a plurality of complex resonance electrodes 29, 30 and a plurality of single resonance electrodes 31*a*, 31*b*, 31*c*, 31*d*.

In addition, the widths of the input coupling auxiliary electrode 46*a* and the output coupling auxiliary electrode 46*b* are set to be approximately the same as that of the input coupling electrode 40*a* and the second output coupling electrode 40*c*, for example. The space between the input coupling auxiliary electrode 46*a* and the output coupling auxiliary electrode 46*b* on one hand and the resonance auxiliary electrodes 32*a*, 32*b* on the other hand is preferably small so that stronger coupling occurs, but this makes manufacturing difficult, and therefore, it is set to be approximately 0.01 to 0.5 mm, for example.

Seventh, Eighth and Ninth Embodiments

Figure 19:
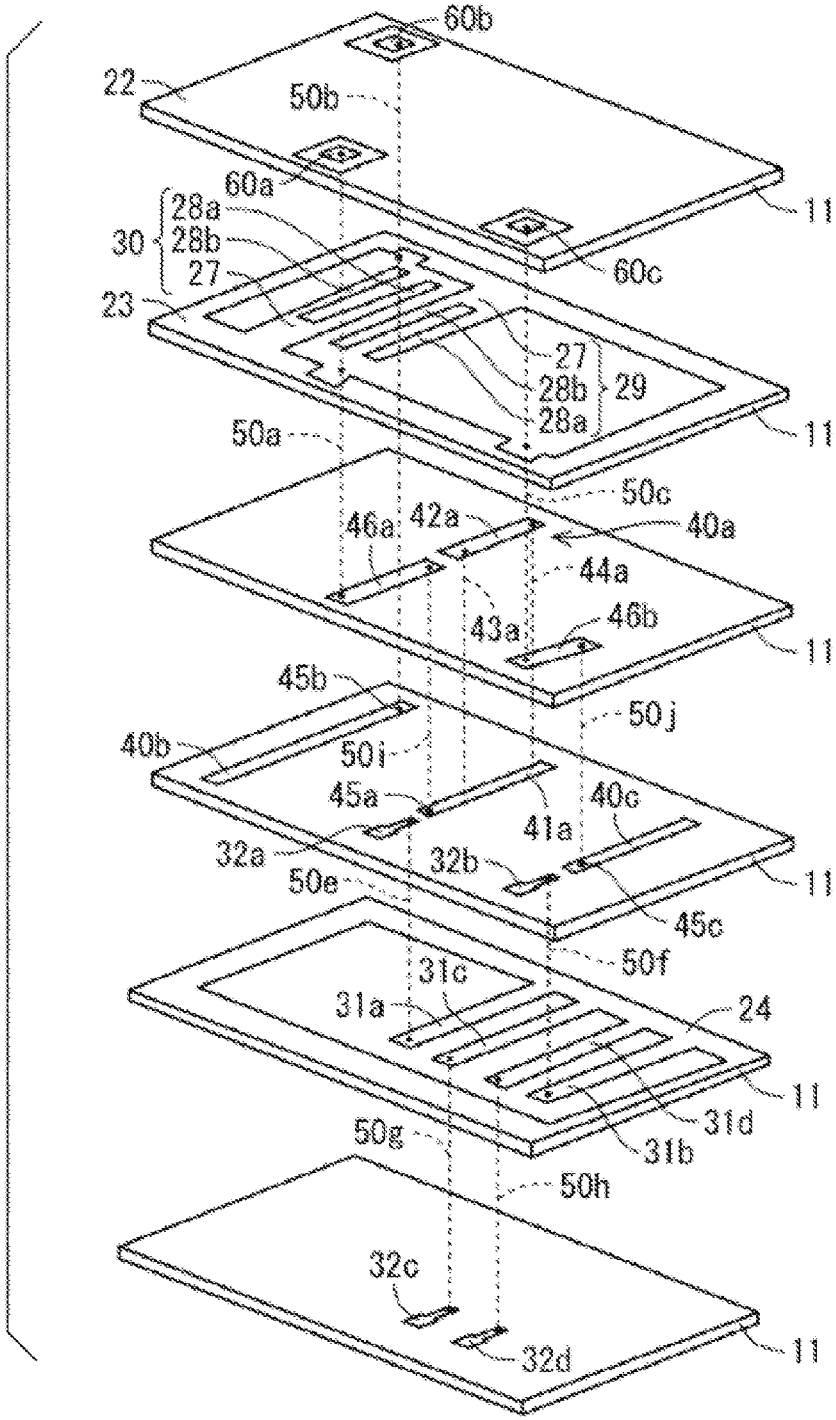
FIG. 19 is an exploded perspective view schematically showing the diplexer according to the seventh embodiment of the present invention.
Figure 20:
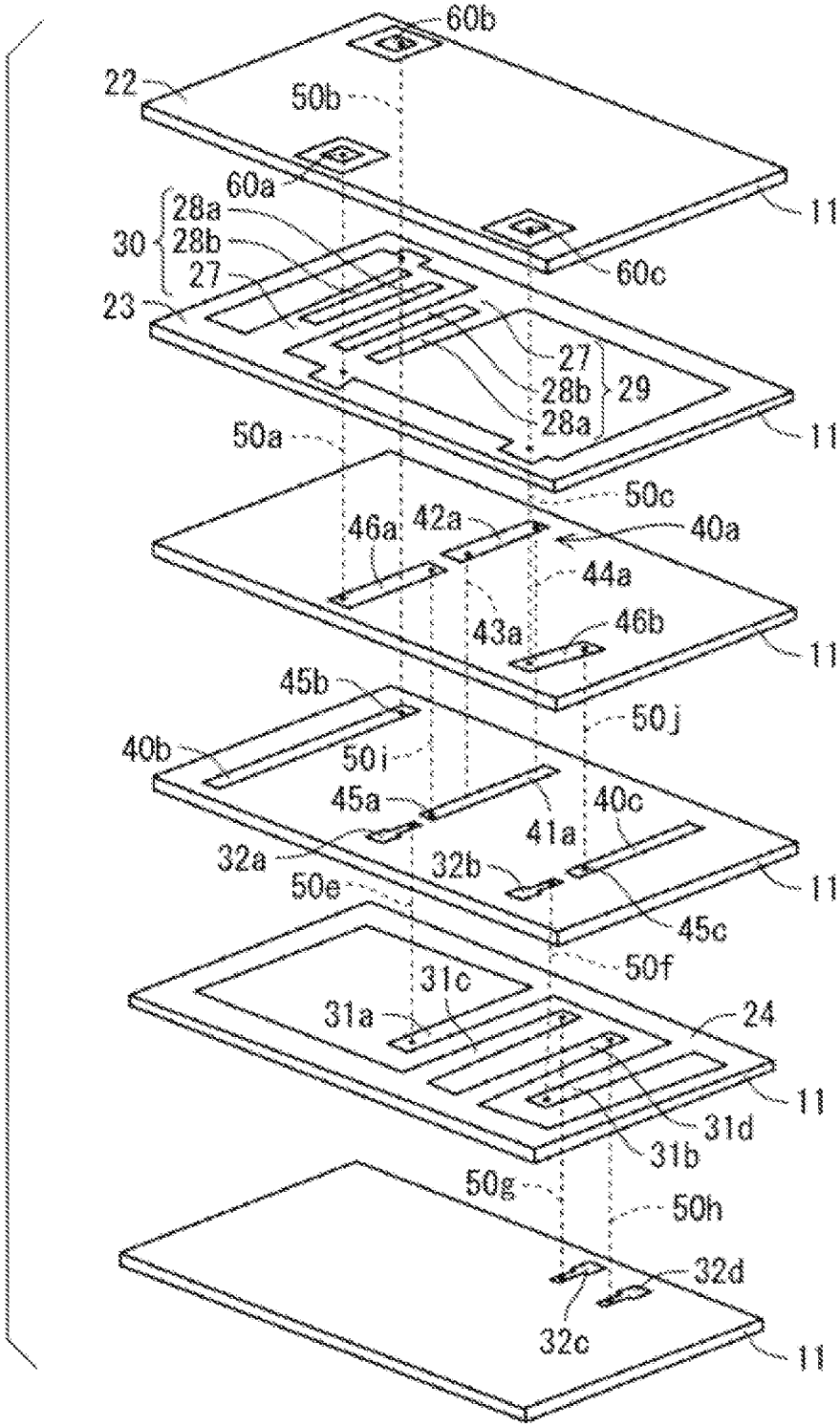
FIG. 20 is an exploded perspective view schematically showing the diplexer according to the eighth embodiment of the present invention.
Figure 21:
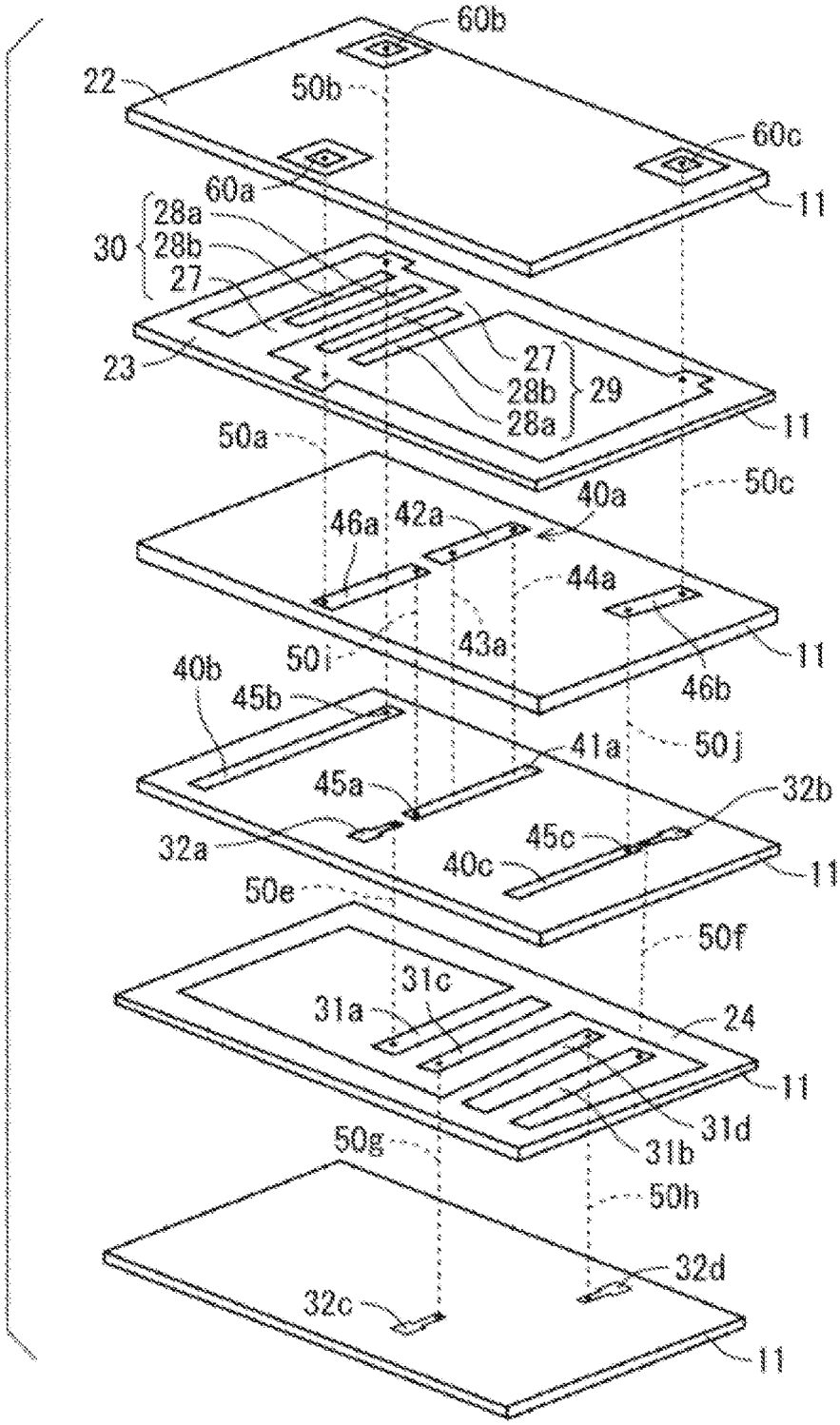
FIG. 21 is an exploded perspective view schematically showing the diplexer according to the ninth embodiment of the present invention.

FIG. 19 is an exploded perspective view schematically showing the diplexer according to the seventh embodiment of the present invention, FIG. 20 is an exploded perspective view schematically showing the diplexer according to the eighth embodiment of the present invention, and FIG. 21 is an exploded perspective view schematically showing the diplexer according to the ninth embodiment of the present invention. In addition, in these embodiments, only aspects different from the abovementioned sixth embodiment will be explained so as to omit redundant explanations, and the same reference characters are used for similar components.

In the diplexer according to the seventh embodiment shown in FIG. 19, all of the single resonance electrodes 31*a*, 31*b*, 31*c*, 31*d* are disposed side by side so that one end and the other end of each are aligned on the same side and coupled in a comb-line form. In the diplexer according to the eighth embodiment shown in FIG. 20, they are disposed side by side so that the single resonance electrode 31*a* and the single resonance electrode 31*c* are coupled in an inter-digital form, the single resonance electrode 31*c* and the single resonance electrode 31*d* are coupled in a comb-line form, and the single resonance electrode 31*d* and the single resonance electrode 31*b* are coupled in an inter-digital form. In the diplexer according to the ninth embodiment shown in FIG. 21, they are disposed side by side so that the single resonance electrode 31*a* and the single resonance electrode 31*c* are coupled in a comb-line form, the single resonance electrode 31*c* and the single resonance electrode 31*d* are coupled in an inter-digital form, and the single resonance electrode 31*d* and the single resonance electrode 31*b* are coupled in a comb-line form.

Depending on changes in the positional relationship of one end and the other end of each of the single resonance electrodes 31*b*, 31*c*, 31*d*, the locations and orientations of the resonance auxiliary electrodes 32*b*, 32*c*, 32*d*, the second output coupling electrode 40*c*, and the output coupling auxiliary electrode 46*b* also vary.

Also, in the diplexers according to the seventh to ninth embodiments comprising such configurations, effects similar to those of the diplexer of the abovementioned sixth embodiment can be obtained.

Tenth Embodiment

Figure 22:
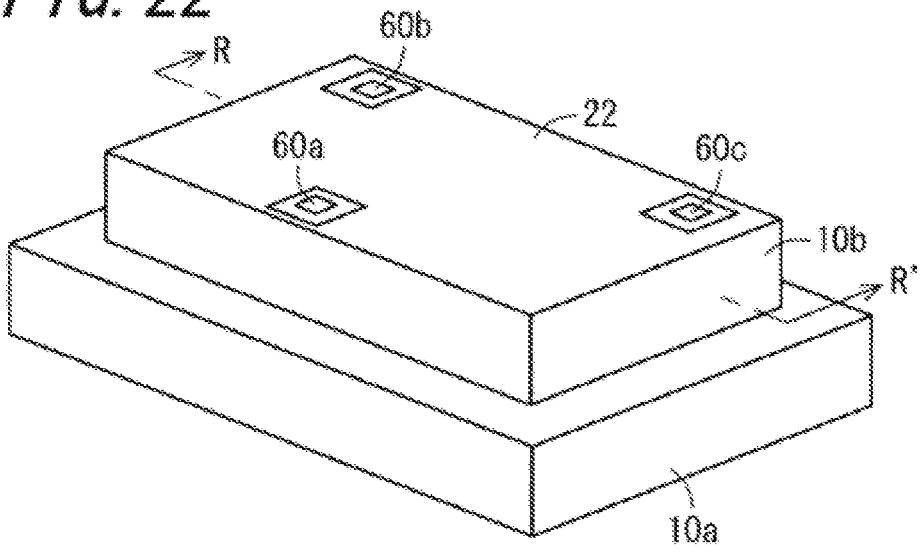
FIG. 22 is an external perspective view schematically showing the diplexer according to the tenth embodiment of the present invention.
Figure 23:
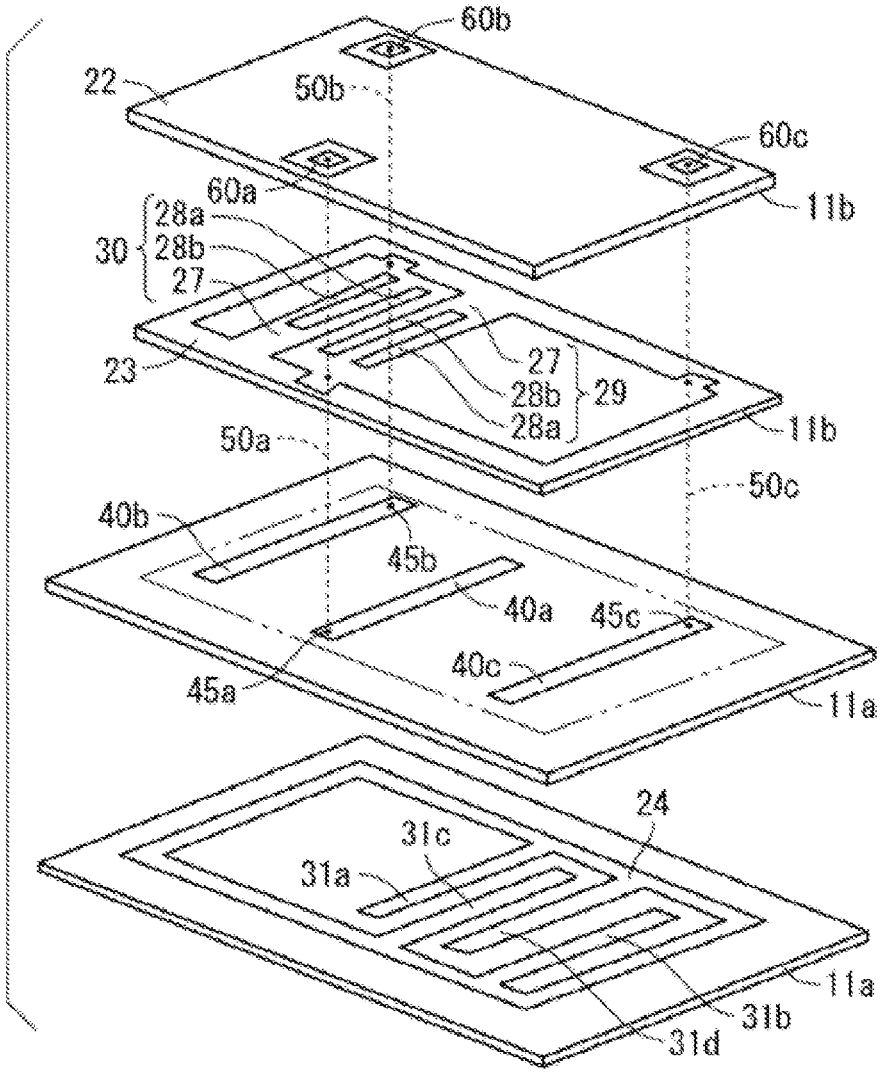
FIG. 23 is a schematic exploded perspective view of the diplexer shown in FIG. 22.
Figure 24:
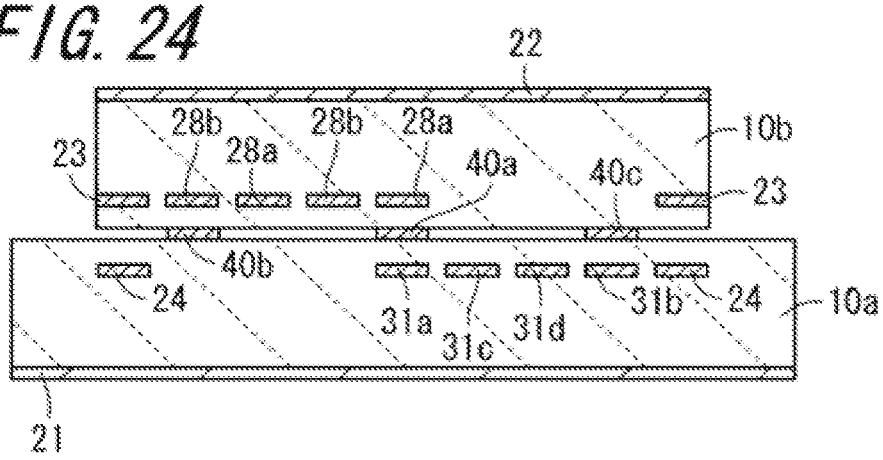
FIG. 24 is a cross-sectional view taken from the line R-R' in FIG. 22.

FIG. 22 is an external perspective view schematically showing the diplexer according to the tenth embodiment of the present invention. FIG. 23 is a schematic exploded perspective view of the diplexer shown in FIG. 22. FIG. 24 is a cross-sectional view taken from the line R-R' in FIG. 22. In addition, in this embodiment, only aspects different from the abovementioned fifth embodiment will be explained so as to omit redundant explanations, and the same reference characters are used for similar components.

In the diplexer of this embodiment, as shown in FIG. 22 to FIG. 24, a laminated body is composed of a first laminated body 10*a* and a second laminated body 10*b* disposed thereon, a first ground electrode 21 is disposed on the bottom surface of the first laminated body 10*a*, a second ground electrode 22 is disposed on the top surface of the second laminated body 10*b*, a first interlayer where complex resonance electrodes 29, 30 and a first annular ground electrode 23 are disposed is an interlayer in the second laminated body 10*b*, a second interlayer where single resonance electrodes 31*a*, 31*b*, 31*c*, 31*d* and a second annular ground electrode 24 are disposed is an interlayer in the first laminated body 10*a*, and the input coupling electrode 40*a*, the first output coupling electrode 40*b*, and the second output coupling electrode 40*c* are disposed on the interlayer between the first laminated body 10*a* and the second laminated body 10*b*. In addition, the first laminated body 10*a* is composed by laminating a plurality of dielectric layers 11*a*, and the second laminated body 10*b* is composed by laminating a plurality of dielectric layers 11*b*.

According to the diplexer of this embodiment comprising such a configuration, because the regions where each of the complex resonance electrodes 29, 30 and the single resonance electrodes 31*a*, 31*b*, 31*c*, 31*d* with different resonance frequencies to each other are divided into the first laminated body 10*a* and the second laminated body 10*b* at the boundary of the interlayer where the input coupling electrode 40*a*, the first output coupling electrode 40*b*, and the second output coupling electrode 40*c* are disposed, it is possible to easily obtain desired electrical characteristics by changing the properties of the dielectric layers composing the first laminated body 10*a* and the second laminated body 10*b*, respectively. For example, by making the permittivity of the dielectric layer 11*a* composing of the first laminated body 10*a*, where the single resonance electrodes 31*a*, 31*b*, 31*c*, 31*d* that are longer than the complex resonance electrodes 29, 30 due to the low resonance frequency are disposed, higher than the permittivity of the dielectric layer 11*b* composing the second laminated body 10*b* allows the length of the single resonance electrodes 31*a*, 31*b*, 31*c*, 31*d* to be shortened so that wasted space within the diplexer is avoided to minimize the size of the diplexer.

Additionally, because the diplexer of this embodiment has a structure that does not require the electromagnetic coupling of electrodes that are disposed so as to be separated into the top and bottom with an interlayer, where the input coupling electrode 40*a*, the first output coupling electrode 40*b*, and the second output coupling electrode 40*c* are disposed, located therebetween, it can be divided into the first laminated body 10*a* and second laminated body 10*b* at the boundary of the interlayer where the input coupling electrode 40*a*, the first output coupling electrode 40*b*, and the second output coupling electrode 40*c* are disposed, and therefore, if displacement occurs between the first laminated body 10*a* and the second laminated body 10*b*, or if an air layer intervenes in the boundary between the first laminated body 10*a* and the second laminated body 10*b*, etc., the exacerbation of electrical characteristics can be minimized. Furthermore, for example, if the first laminated body 10*a* is a module substrate where other electronic parts, etc. are mounted on the surface of a region other than the region in which a diplexer is configured, part of the diplexer is disposed in the second laminated body 10*b*, and as a result, the thickness of the module substrate can be thinned, making it possible to obtain a substrate with a diplexer in which the thickness of the entire module can be thinned.

The electrical characteristics of the diplexer of the sixth embodiment shown in FIG. 15 to FIG. 18 are computed through a simulation by using a finite element method. As the computation conditions, the complex resonance electrode on the input stage 29 and the complex resonance electrode on the output stage 30 are structured so that the rectangular protruding member on the input stage 28*a* that is 0.25 mm in width and 2.1 mm in length and the rectangular protruding member on the output stage 28*b* that is 0.2 mm in width and 2.25 mm in length are disposed 0.6-mm apart from the other end of the rectangular base member 27 that is 1.05 mm in width and 0.95 mm in length, each one end and the other end are disposed side by side so as to alternate by a space of 0.25 mm. The single resonance electrodes 31*a*, 31*b*, 31*c*, 31*d* are made into a rectangle 0.3 mm in width and 3.6 mm in length, the space between the single resonance electrode 31*a* and 31*c* is made to be 0.2 mm, the space between the single resonance electrode 31*c* and 31*d* is made to be 0.27 mm, and the space between the single resonance electrode 31*d* and 31*b* is made to be 0.2 mm. The resonance auxiliary electrode on the input stage 32*a* and the resonance auxiliary electrode on the output stage 32*b* are formed so as to join a rectangle that is 0.45 mm in width and 0.49 mm in length and disposed at a location 0.2 mm apart from the other ends of the single resonance electrodes 31*a*, 31*b* with a rectangle that is 0.2 mm in width and 0.5 mm in length and faces towards the single resonance electrodes 31*a*, 31*b*. The other resonance auxiliary electrodes 32*c*, 32*d* are formed so as to join a rectangle that is 0.47 mm in width and 0.5 mm in length and disposed at a location 0.2 mm apart from the other ends of the single resonance electrodes 31*c*, 31*d* with a rectangle that is 0.2 mm in width and 0.5 mm in length and faces towards the single resonance electrodes 31*c*, 31*d*.

The first input coupling conductor 41*a* is formed so that an extension that is 0.45 mm in width and 0.4 mm in length is added for the purpose of adjusting the coupling to the tip of the rectangle that is 0.25 mm in width and 3.7 mm in length. The second input coupling conductor 42*a* is formed so that an extension that is 0.45 mm in width and 0.4 mm in length is added for the purpose of adjusting the coupling to the tip of the rectangle that is 0.25 mm in width and 2.6 mm in length. In turn, the input-side connecting conductor 43*a* and the input-side connecting auxiliary conductor 44*a* composed of via holes connect the first input coupling conductor 41*a* and the second input coupling conductor 42*a* so as to configure the input coupling electrode 40*a*.

The first output coupling electrode 40*b* and the second output coupling electrode 40*c* are made into a rectangle 0.25 mm in width and 3.2 mm in length. The input coupling auxiliary electrode 46*a* and the output coupling auxiliary electrode 46*b* are made into a rectangle 0.25 mm in width and 1.1 mm in length.

The input terminal electrode 60*a*, the first output terminal electrode 60*b*, and the second output terminal electrode 60*c* are made into a square that is 0.3 mm on each side. The outlines of the first ground electrode 21, the second ground electrode 22, the first annular ground electrode 23, and the second annular ground electrode 24 are made to be 5 mm in width and 6 mm in length, the opening of the first annular ground electrode 23 is made into a rectangle 3.75 mm in width and 4.9 mm in length, and the opening of the second annular ground electrode 24 is made into a rectangle 3.25 mm in width and 3.9 mm in length. The entire shape of the diplexer is made into a rectangular parallelepiped 5 mm in width, 6 mm in length, and 0.98 mm in thickness so that the interlayer is located at approximately the center in the thickness direction. The space between the adjacent interlayers from among the first interlayer, the second interlayer, the interlayer A, the interlayer B, and the interlayer C (spaces between various types of electrodes located on the adjacent interlayers) is made to be 0.065 mm. The thickness of the various types of electrode is made to be 0.01 mm, and the diameter of various types of through-conductors is made to be 0.1 mm. The relative permittivity of the dielectric layers 11 is made to be 9.45.

Figure 25:
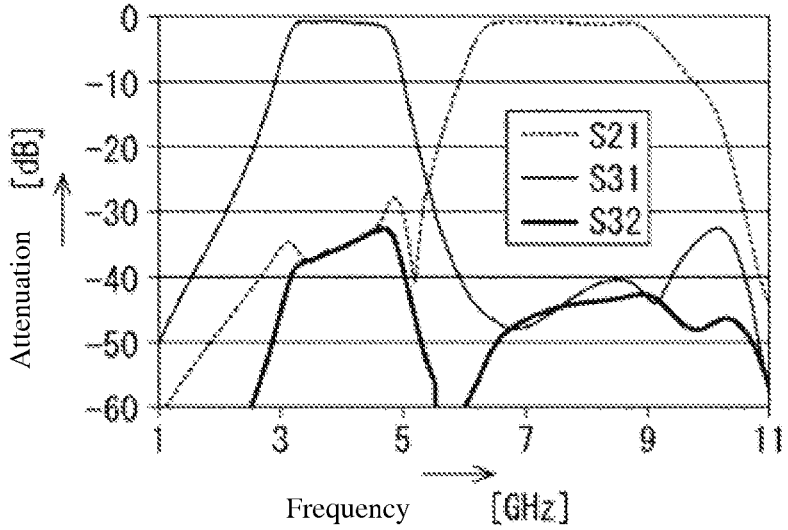
FIG. 25 is a diagram showing simulation results of the electrical characteristics of the diplexer according to the sixth embodiment of the present invention.
Figure 26:
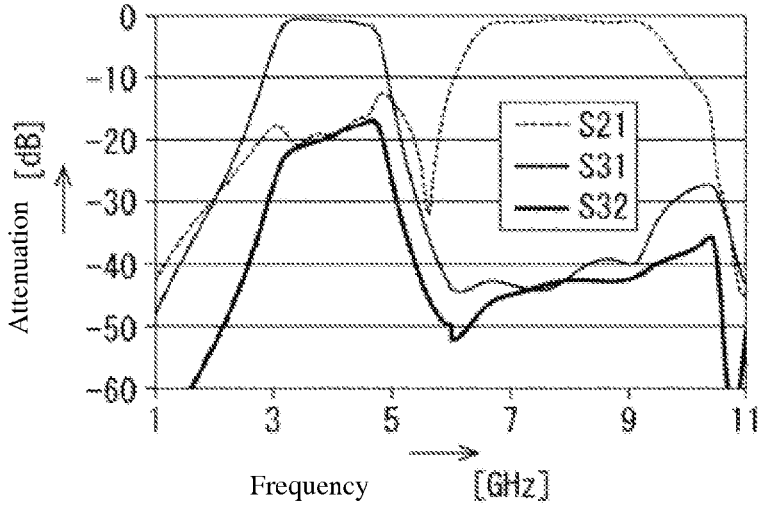
FIG. 26 is a diagram showing simulation results of the electrical characteristics of the diplexer according to a comparative example.

FIG. 25 is a graph showing the simulation results. FIG. 26 is a graph showing simulation results of the electrical characteristics of the diplexer of a comparative example comprising a similar structure as the diplexer of the sixth embodiment shown in FIG. 15 to FIG. 18, except that two complex resonance electrodes 29, 30 are replaced with four single resonance electrodes that are disposed side by side so as to be coupled to each other in an inter-digital form. In each of the graphs, the horizontal axis indicates frequency and the vertical axis indicates attenuation, showing the bandpass characteristics (S21, S31) and isolation characteristics (S32) of the diplexer, where the input terminal electrode 60*a* is port 1, the first output terminal electrode 60*b* is port 2, and the second output terminal electrode 60*c* is port 3.

According to the graph shown in FIG. 26, although low-loss bandpass characteristics are obtained across the two wide passbands, S32 is approximately −20 dB at a frequency of approximately 3 to 5 GHz around the passband formed by the single resonance electrodes 31*a*, 31*b*, 31*c*, 31*d*, suggesting that the isolation characteristics of the diplexer as a comparative example need to be improved.

On the other hand, according to the graph shown in FIG. 25, S32 is approximately −35 dB at a frequency of approximately 3 to 5 GHz around the passband formed by the single resonance electrodes 31*a*, 31*b*, 31*c*, 31*d*, suggesting that it improves by 15 dB or more compared to the graph shown in FIG. 26, and substantially excellent isolation characteristics are obtained. Based on this result, according to the diplexer of the present invention, excellent flat and low-loss bandpass characteristics and excellent isolation characteristics can be obtained across the two wide passbands, where the effectiveness of the present invention was observed.

Eleventh and Twelfth Embodiments

Figure 27:
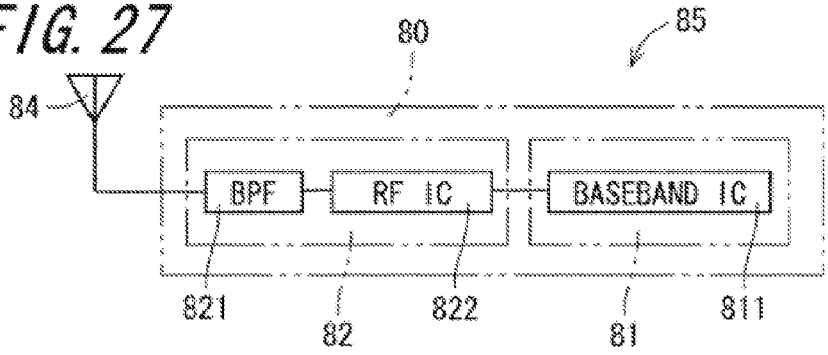
FIG. 27 is a block diagram showing an example configuration of a wireless communication module and a wireless communication device that use the bandpass filter according to the eleventh embodiment of the present invention.

FIG. 27 is a block diagram showing an example configuration of a wireless communication module 80 and a wireless communication device 85 using the bandpass filter according to the eleventh embodiment of the present invention.

The wireless communication module 80 (80A) of this embodiment comprises, for example, a baseband portion 81 where baseband signals are processed, and an RF portion 82 (82A) connected to the baseband portion 81 and where baseband signals after modulation and RF signals before demodulation are processed.

The RF portion 82 includes the abovementioned bandpass filter 821 (diplexer 821A) of the present invention where RF signals that are made from modulated baseband signals or signals at other communication bands than the received RF signals are attenuated via the bandpass filter 821 (diplexer 821A).

As a specific configuration, on the baseband portion 81, a baseband IC 811 is disposed, and on the RF portion 82, an RF IC 822 is disposed between the bandpass filter 821 (diplexer 821A) and the baseband portion 81. In addition, another circuit may be interposed between these circuits.

In turn, an antenna 84 is connected to the bandpass filter 821 (diplexer 821A) of the wireless communication module 80, thus configuring a wireless communication device 85 (85A) of this embodiment to send and receive RF signals.

According to the wireless communication module 80 and the wireless communication device 85 of this embodiment having such a configuration, the bandpass filter 821 of the present invention with small signal loss, where input impedance is well matched and passed across the entire frequency band used for communication, is used for filtering waves of sent signals and received signals, resulting in less attenuation of sent signals and received signals that pass the bandpass filter 821 and increased the reception sensitivity, and also, the amplification of sent signals and received signals can be small, resulting in less power consumption in the amplifier circuit. Therefore, an enhanced wireless communication module 80 and wireless communication device 85 with high receiving sensitivity and low power consumption can be obtained.

Figure 28:
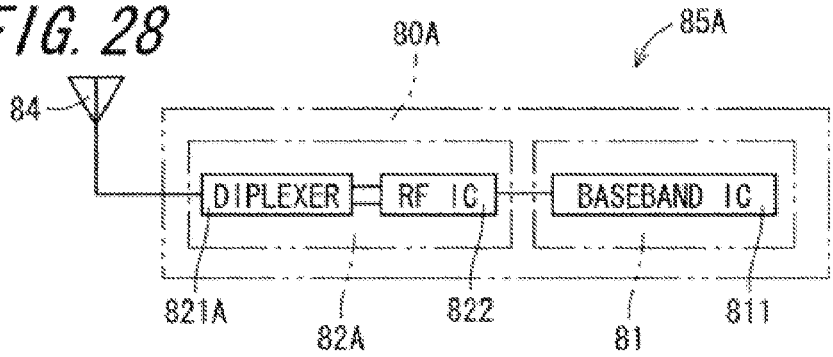
FIG. 28 is a block diagram showing an example configuration of a wireless communication module and a wireless communication device that use the diplexer according to the twelfth embodiment of the present invention.

FIG. 28 is a block diagram showing an example configuration of a wireless communication module 80A and a wireless communication device 85A using the bandpass filter according to the twelfth embodiment of the present invention. As shown in FIG. 28, in the wireless communication module 80A and the wireless communication device 85A of this embodiment having the illustrated configuration, the diplexer 821A of the present invention with small signal loss passing across two frequency bands used for communication is used for filtering waves of sent signals and received signals, resulting in less attenuation of received signals and sent signals that pass the diplexer 821A and increased the reception sensitivity, and also, the amplification of sent signals and received signals can be small, resulting in less power consumption in the amplifier circuit. Therefore, an enhanced wireless communication module 80A and wireless communication device 85A with high receiving sensitivity and low power consumption can be obtained. Furthermore, because two bandpass filters that respectively pass signals of two communication bands are integrated into one diplexer 821A and two terminals of the RF IC 822 and the antenna 84 can be directly connected via the diplexer 821A of the present invention, a small wireless communication module 80A and wireless communication device 85A with low manufacturing cost can be obtained.

In the abovementioned complex resonator, bandpass filter, and diplexer, as the material for the dielectric layers 11, 11*a*, 11*b*, for example, resins such as epoxy or ceramics such as dielectric ceramics may be used. For example, glass-ceramic materials that comprise dielectric ceramics materials such as $BaTiO_3$, $Pb_4Fe_2Nb_2O_{12}$, $TiO_2$ and glass materials such as $B_2O_3$, $SiO_2$, $Al_2O_3$, ZnO and can be fired at relatively lower temperatures of approximately 800 to 1,200° C. are preferably used.

Additionally, the thickness of the dielectric layer 11 is set to be approximately 0.01 to 0.1 mm, for example.

As the materials for the abovementioned various types of electrodes and through-conductors, for example, conductive materials composed mostly of Ag alloys such as Ag, Ag—Pd, Ag—Pt or Cu, W, Mo, Pd-based conductive materials are preferably used. The thickness of various types of electrodes is set to be 0.001 to 0.2 mm, for example.

The abovementioned complex resonator, bandpass filter, and diplexer are, for example, manufactured as follows. Firstly, slurry is made by adding and mixing an appropriated organic solvent, etc. into ceramic raw powder, and at the same time, a ceramic green sheet is formed by using the doctor blade method. Subsequently, through-holes to form through-conductors are created on the resulting ceramic green sheet by using a punching machine, etc. and filled with conductor paste containing conductors such as Ag, Ag—Pd, Au, or Cu, and ceramic green sheets with conductor paste are created on the surface of the ceramic green sheet by applying the same conductor paste as the above by using the printing method. Then, these ceramic green sheets with conductor paste are laminated, compressed by using a hot pressing device, and fired at a peak temperature of approximately 800° C. to 1,050° C.

Variations

The present invention is not limited to the abovementioned first to twelfth embodiments, but rather, a variety of changes and modification may be made without departing from the scope of the present invention.

For example, in the bandpass filter of the third embodiment and the fourth embodiment shown in FIG. 7 to FIG. 9, while examples of the complex resonance electrode on the input stage 29 and the complex resonance electrode on the output stage 30 comprising two complex resonance electrodes are shown, other complex resonance electrodes may be disposed between the complex resonance electrode on the input stage 29 and the complex resonance electrode on the output stage 30. Note, however, that if the number of complex resonance electrodes is excessive, the bandpass filter becomes large and the signal loss that passes therethrough becomes great, and therefore, in practice, the number of complex resonance electrodes is set to be approximately 10 or fewer. Additionally, while examples in which the input coupling electrode 40*a* and output coupling electrode 40*d* as well as the complex resonance electrode on the input stage 29 and the complex resonance electrode on the output stage 30 are disposed so as to be respectively electromagnetically coupled in an inter-digital form are shown, the input coupling electrode 40*a* and the complex resonance electrode on the input stage 29 may be disposed so as to be coupled in a comb-line form, and the output coupling electrode 40*d* and the complex resonance electrode on the output stage 30 may be disposed so as to be coupled in a comb-line form.

Additionally, in the abovementioned bandpass filter of the first to fourth embodiments, while examples in which the annular ground electrode 25 are disposed on the first interlayer of the laminated body are shown, the annular ground electrode 25 is not necessarily required. Additionally, if a bandpass filter is formed in a region on the module substrate, the input terminal electrode 60*a* and the output terminal electrode 60*d* are not necessarily required, and for example, a wiring conductor within the module substrate from the external circuit may be directly connected to the input coupling electrode 40*a* (or coupling electrode for inputting 48*a*) and the output coupling electrode 40*d* (or coupling electrode for outputting 48*b*). In this case, the connection points between the input coupling electrode 40*a* and the output coupling electrode 40*d* and the wiring conductor respectively become the electrical signal input point 45*a* of the input coupling electrode 40*a* and the electrical signal output point 45*d* of the output coupling electrode 40*d*. Furthermore, the input coupling electrode 40*a* (or coupling electrode for inputting 48*a*) and the output coupling electrode 40*d* (or coupling electrode for outputting 48*b*) may be disposed on different interlayers on the laminated body.

Additionally, in the abovementioned fifth to tenth embodiments, while examples comprising the input terminal electrode 60*a*, the first output terminal electrode 60*b*, and the second output terminal electrode 60*c* are shown, if, for example, a diplexer is formed within a region of the substrate such as a module substrate, the input terminal electrode 60*a*, the first output terminal electrode 60*b*, and the second output terminal electrode 60*c* are not necessarily required, and for example, a wiring conductor within the module substrate from the external circuit may be directly connected to the input coupling electrode 40*a*, the first output coupling electrode 40*b*, and the second output coupling electrode 40*c*. In this case, the connection points between the input coupling electrode 40*a*, the first output coupling electrode 40*b*, and the second output coupling electrode 40*c* and the wiring conductor become the electrical signal input point 45*a*, the first electrical signal output point 45*b*, and the second electrical signal output point 45*c*, respectively. Additionally, a wiring conductor within the module substrate from the external circuit may be directly connected to the input coupling auxiliary electrode 46*a* and the output coupling auxiliary electrode 46*b*.

Additionally, in the abovementioned sixth to ninth embodiments, while examples in which the resonance auxiliary electrode on the input stage 32*a* and the resonance auxiliary electrode on the output stage 32*b* are disposed on the interlayer A of the laminated body in a manner identical to the first input coupling conductor 41*a* and the second output coupling electrode 40*c* are shown, the resonance auxiliary electrode on the input stage 32*a* and the resonance auxiliary electrode on the output stage 32*b* may be disposed on another interlayer of the laminated body.

Furthermore, in the abovementioned sixth to ninth embodiments, while examples in which the resonance auxiliary electrodes 32*c*, 32*d* are disposed on a different interlayers from the resonance auxiliary electrode on the input stage 32*a* and the resonance auxiliary electrode on the output stage 32*b* are shown, they may be disposed on the same interlayer as the resonance auxiliary electrode on the input stage 32*a* and the resonance auxiliary electrode on the output stage 32*b*.

Furthermore, in the abovementioned sixth to ninth embodiments, while examples in which the input coupling auxiliary electrode 46*a* and the output coupling auxiliary electrode 46*b* are disposed on the interlayer B in a manner identical to the second input coupling conductor 42*a* are shown, the input coupling auxiliary electrode 46*a*, the output coupling auxiliary electrode 46*b*, and the second input coupling conductor 42*a* may be disposed on different interlayers of the laminated body. Additionally, the input coupling auxiliary electrode 46*a* and the output coupling auxiliary electrode 46*b* may be disposed on different interlayers.

Furthermore, in the abovementioned sixth to ninth embodiments, while examples in which the input coupling auxiliary electrode 46*a* is connected to the first input coupling conductor 41*a* via through-conductors 50*i* are shown, for example, the input coupling auxiliary electrode 46*a* may be directly connected to the second input coupling conductor 42*a*.

Furthermore, in the abovementioned first to tenth embodiments, while examples in which the first ground electrode 21 is disposed on the bottom surface of the laminated body and the second ground electrode 22 is disposed on the top surface of the laminated body are shown, for example, dielectric layers may be further disposed under the first ground electrode 21 and dielectric layers may be further disposed above the second ground electrode 22. Additionally, without disposing the second ground electrode 22, only the first ground electrode 21 may be included.

Furthermore, in the abovementioned fifth to tenth embodiments, while examples comprising two complex resonance electrodes 29, 30 and four single resonance electrodes 31*a*, 31*b*, 31*c*, 31*d* are shown, the number of complex resonance electrodes and single resonance electrodes may be changed depending on the necessary passband width and attenuation outside of the passband. If the necessary passband width is narrow or the necessary attenuation outside of the passband is small, the number of resonance electrodes may be reduced, or in contrast, if the necessary passband width is wide or the necessary attenuation outside of the passband is large, etc., the number of resonance electrodes may be further increased. Note, however, that if the number of resonance electrodes increases excessively, the size becomes large and loss within the passband increases, and therefore, it is desirable for the number of complex resonance electrodes and single resonance electrodes to be set to be approximately 10 or fewer.

Furthermore, in the abovementioned tenth embodiment, while an example of a diplexer divided into the first laminated body 10*a* and the second laminated body 10*b* at the boundary of the interlayer where the input coupling electrode 40*a*, the first output coupling electrode 40*b*, and the second output coupling electrode 40*c* are disposed is shown, it may be divided into the first laminated body 10*a* and the second laminated body 10*b* at another interlayer depending on the situation and may be divided into more laminated bodies.

Furthermore, while the explanation has been made based on examples of diplexers used for UWB, needless to say, the diplexer of the present invention is also useful in other applications requiring broadband.

The present invention may be implemented in a variety of other forms without departing from the spirit and main characteristics thereof. Therefore, the abovementioned embodiments are merely exemplary in all aspects, and the scope of the present invention is not be limited in any way by the specification and should be defined only by the appended claims. Furthermore, all variations and modifications falling within the scope of the claims fall within the scope of the present invention.

The invention claimed is:

1. A bandpass filter comprising:

a laminated body comprising:

i) a plurality of laminated dielectric layers;

ii) a ground electrode on a first surface of the laminated body, operable to be connected to a standard potential;

iii) a plurality of complex resonance electrodes, located on a first interlayer of the laminated body, each of the complex resonance electrodes comprising:

a first end portion; and a second end portion which is divided into a plurality of divided portions arranged side by side, each divided portion having a strip shape, wherein each of the complex resonance electrodes is operable to be connected to the standard potential at its first end portion and resonate at a first frequency while the plurality of divided portions are operable to resonate at a second frequency higher than the first frequency;

wherein adjacent ones of the plurality of complex resonance electrodes are arranged side by side such that the first end portion and the second end portion are alternately arranged, and the complex plurality of resonance electrodes are electromagnetically coupled to each other;

iv) an input coupling electrode:

having a strip shape;

located on a second interlayer different from the first interlayer of the laminated body;

facing to an input stage divided portion among the plurality of divided portions of an input stage complex resonance electrode among the plurality of complex resonance electrodes;

electromagnetically coupled to the input stage divided portion; and having an electrical signal input point into which electrical signals are input; and v) an output coupling electrode:

having a strip shape;

located on a third interlayer different from the first interlayer of the laminated body;

facing to an output stage divided portion among the plurality of divided portions of an output stage complex resonance electrode among the plurality of complex resonance electrodes;

electromagnetically coupled to the output stage divided portion; and having an electrical signal output point into which said electrical signals are output.

2. A wireless communication module comprising:

an RF unit comprising the bandpass filter according to claim 1; and a baseband unit connected to the RF unit.

3. A wireless communication device comprising:

an RF unit comprising the bandpass filter according to claim 1;

a baseband unit connected to the RF unit; and an antenna connected to the RF unit.

4. A diplexer comprising:

a laminated body comprising:

i) a plurality of laminated dielectric layers;

ii) a ground electrode on a first surface of the laminated body, operable to be connected to a standard potential;

iii) a plurality of the complex resonance electrodes, located on a first interlayer of the laminated body, each of the complex plurality of resonance electrodes comprising:

a first end portion; and a second end portion which is divided, into a plurality of divided portions arranged side by side, each divided portion having a strip shape, wherein each of the complex plurality of resonance electrodes is operable to be connected to the standard potential at its first end portion and resonate at a first frequency while the plurality of divided portions are operable to resonate at a second frequency higher than the first frequency:

wherein adjacent ones of the plurality of complex resonance electrodes are arranged side by side such that the first end portion and the second end portion are alternately arranged, and the complex plurality of resonant electrodes are electromagnetically coupled to each other;

iv) a plurality of single resonance electrodes:

having a strip shape;

located on a second interlayer different from the first interlayer of the laminated body;

arranged side by side; and electromagnetically coupled to each other, wherein a first end of each single resonance electrode is connected to the standard potential, and wherein the plurality of single resonance electrodes resonate at a third frequency different from the first frequency and the second frequency;

v) an input coupling electrode:

having a strip shape;

located on a third interlayer between the first interlayer and the second interlayer of the laminated body;

facing to an input stage divided portion among the plurality of divided portions of an input stage complex resonance electrode among the plurality of complex resonance electrodes;

electromagnetically coupled to the input stage divided portion of the input stage complex resonance electrode;

facing to an input stage single resonance electrode among the plurality of single resonance electrode;

electromagnetically coupled to the input stage single resonance electrode; and having an electrical signal input point into which electrical signals are input;

vi) a first output coupling electrode:

having a strip shape;

located on a fourth interlayer different from the first interlayer;

facing to an output stage divided portion among the plurality of divided portions of an output stage complex resonance electrode among the plurality of complex resonance electrodes;

electromagnetically coupled to the output stage divided portion of the output stage complex resonance electrode; and having a first said electrical signal output point into which electrical signals are output;

vii) a second output coupling electrode:

having a strip shape;

located on a fifth interlayer different from the second interlayer;

facing to an output stage single resonance electrode among the plurality of single resonance electrodes;

electromagnetically coupled to the output stage single resonance electrode; and having a second said electrical signal output point into which electrical signals are output.

5. The diplexer according to claim 4, wherein the first output coupling electrode and the second output coupling electrode are, when viewed planarly, located on opposite sides of the laminated body with the input coupling electrode located therebetween, the first end of the input stage complex resonance electrode and the first end of the input stage single resonance electrode are located on the same side of the laminated body, on the input coupling electrode, the electrical signal input point is located on a side closer to the second end of the input stage complex resonance electrode than the center of the portion facing against the input stage complex resonance electrode, and at the same time is located on a side closer to a second end of the input stage single resonance electrode than the center of the portion facing against the input stage single resonance electrode, on the first output coupling electrode, the first electrical signal output point is located on a side closer to the second end of the output stage complex resonance electrode than the center of a portion facing against the output stage complex resonance electrode, and on the second output coupling electrode, the second electrical signal output point is located on a side closer to the second end of the output stage single resonance electrode than the center of the portion facing against the output stage single resonance electrode.

6. The diplexer according to claim 4, wherein the laminated body is composed of a first laminated body and a second laminated body disposed on the first laminated body, the ground electrode is disposed on the bottom surface of the first laminated body, the plurality of complex resonance electrodes and the plurality of single resonance electrodes are each disposed within a different laminated body selected from the first laminated body and the second laminated body, and the input coupling electrode, the first output coupling electrode, and the second output coupling electrode are disposed between the first laminated body and the second laminated body.

7. A wireless communication module comprising:

an RF unit comprising the diplexer according to claim 4; and a baseband unit connected to the RF unit.

8. A wireless communication device comprising:

an RF unit comprising the diplexer according to claim 4;

a baseband unit connected to the RF unit; and an antenna connected to the RF unit.

9. A bandpass filter, comprising:

a laminated body comprising:

i) a plurality of laminated dielectric layers;

ii) a first ground electrode on a first surface of the laminated body, operable to be connected to a standard potential;

iii) a second around electrode on a first interlayer of the laminated body, operable to be connected to the standard potential;

iv) a plurality of complex resonance electrodes on the first interlayer of the laminated body, each of the complex resonance electrodes comprising:

a first end portion and a second end portion which is divided into a plurality of divided portions arranged side by side, each divided portion having a strip shape, wherein each of the plurality of complex resonance electrodes is connected to the second ground electrode at its first end portion and arranged such that the complex resonance electrode extends from the second ground electrode, wherein adjacent ones of the plurality of complex resonance electrodes are arranged side by side such that the first end portion and the second end portion are alternately arranged, and the plurality of complex resonance electrodes are electromagnetically coupled to each other;

v) an input coupling electrode:

having a strip shape;

located on a second interlayer different from the first interlayer of the laminated body;

facing to an input stage divided portion among the plurality of divided portions of an input stage complex resonance electrode among the plurality of complex resonance electrodes;

electromagnetically coupled to the input stage divided portion; and having an electrical signal input point into which electrical signals are input; and vi) an output coupling electrode:

having a strip shape;

located on a third interlayer different from the first interlayer of the laminated body;

facing to an output stage divided portion among the plurality of divided portions of an output stage complex resonance electrode among the plurality of complex resonance electrodes;

electromagnetically coupled to the output stage divided portion; and having an electrical signal output point into which said electrical signals are output.

10. A wireless communication module, comprising:

an RF unit comprising the bandpass filter according to claim 9; and a baseband unit connected to the RF unit.

11. A wireless communication device comprising:

an RF unit comprising the bandpass filter according to claim 9;

a baseband unit connected to the RF unit; and an antenna connected to the RF unit.

12. A diplexer comprising:

a laminated body comprising:

i) a plurality of laminated dielectric layers;

ii) a first ground electrode on a first surface of the laminated body operable to be connected to a standard potential;

iii) a second ground electrode on a first interlayer of the laminated body, operable to be connected to the standard potential;

iv) a plurality of complex resonance electrodes, located on the first interlayer of the laminated body, each of the complex resonance electrodes comprising:

a first end portion and a second end portion which is divided into a plurality of divided portions arranged side by side, each divided portion having a strip shape, wherein each of the complex plurality of resonance electrodes is connected to the second around electrode at its first end portion and arranged such that the complex resonance electrode extends from the second ground electrode, wherein adjacent ones of the plurality of complex resonance electrodes are arranged side by side such that the first end portion and the second end portion are alternately arranged, and the complex plurality of resonance electrodes are electromagnetically coupled to each other;

v) a plurality of single resonance electrodes:

having a strip shape;

located on a second interlayer different from the first interlayer of the laminated body;

arranged side by side; and electromagnetically coupled to each other, wherein a first end of each single resonance electrode is connected to the standard potential, and wherein the plurality of single resonance electrodes function as a resonator that resonates at a frequency different from a frequency at which the complex plurality of resonance electrodes resonate;

vi) an input coupling electrode:

having a strip shape;

located on a third interlayer between the first interlayer and the second interlayer of the laminated body;

facing to an input stage divided portion among the plurality of divided portions of an input stage complex resonance electrode among the plurality of complex resonance electrodes;

electromagnetically coupled to the input stage divided portion;

facing to an input stage single resonance electrode among the plurality of single resonance electrode;

electromagnetically coupled to the input stage single resonance electrode; and having an electrical signal input point into which electrical signals are input;

vi) a first output coupling electrode:

having a strip shape;

located on a fourth interlayer different from the first interlayer;

facing to an output stage divided portion among the plurality of divided portions of an output stage complex resonance electrode among the plurality of complex resonance electrodes;

electromagnetically coupled to the output stage divided portion; and having a first said electrical signal output point into which electrical signals are output;

vii) a second output coupling electrode:

having a strip shape;

located on a fifth interlayer different from the second interlayer;

facing to an output stage single resonance electrode among the plurality of single resonance electrodes;

electromagnetically coupled to the output stage single resonance electrode; and having a second electrical signal output point into which said electrical signals are output.

13. The diplexer according to claim 12, wherein the first output coupling electrode and the second output coupling electrode are, when viewed planarly, located on opposite sides of the laminated body with the input coupling electrode located therebetween, the first end of the input stage complex resonance electrode and the first end of the input stage single resonance electrode are located on the same side of the laminated body, on the input coupling electrode, the electrical signal input point is located on a side closer to the second end of the input stage complex resonance electrode than the center of the portion facing against the input stage complex resonance electrode, and at the same time is located on a side closer to a second end of the input stage single resonance electrode than the center of the portion facing against the input stage single resonance electrode, on the first output coupling electrode, the first electrical signal output point is located on a side closer to the second end of the output stage complex resonance electrode than the center of a portion facing against the output stage complex resonance electrode, and on the second output coupling electrode, the second electrical signal output point is located on a side closer to the second end of the output stage single resonance electrode than the center of the portion facing against the output stage single resonance electrode.

14. The diplexer according to claim 12, wherein the laminated body is composed of a first laminated body and a second laminated body disposed thereon, the first ground electrode is disposed on the bottom surface of the first a laminated body, the plurality of complex resonance electrodes and the plurality of single resonance electrodes are each disposed within a different laminated body selected from the first laminated body and the second laminated body, and the input coupling electrode, the first output coupling electrode, and the second output coupling electrode are disposed between the first laminated body and the second laminated body.

15. A wireless communication module comprising:

an RF unit comprising the diplexer according to claim 12; and a baseband unit connected to the RF unit.

16. A wireless communication device comprising:

an RF unit comprising the diplexer according to claim 12;

a baseband unit connected to the RF unit; and an antenna connected to the RF unit.

* * * * *